US005856817A

United States Patent [19]

Matsuzaki

[11] Patent Number: 5,856,817

[45] Date of Patent: Jan. 5, 1999

[54] DISPLAY CONTROL METHOD AND DISPLAY CONTROLLER AND DISPLAY APPARATUS USING THE SAME

[75] Inventor: Eiichi Matsuzaki, Kawasaki, Japan

[73] Assignee: Canon Kabushiki Kaisha, Tokyo, Japan

[21] Appl. No.: 597,981

[22] Filed: Feb. 7, 1996

[30] Foreign Application Priority Data

Feb. 9, 1995 [JP] Japan ..... 7-021597

[51] Int. Cl.[6] ..... G09G 3/36

[52] U.S. Cl. ..... 345/98; 345/97; 345/507

[58] Field of Search ..... 345/87, 98, 99, 345/100, 103, 97, 88, 89, 507, 516, 517, 514

[56] References Cited

U.S. PATENT DOCUMENTS 4,707,798 11/1987 Nakano ..... 364/765

FOREIGN PATENT DOCUMENTS 0361471 4/1990 European Pat. Off. .
0591682 4/1994 European Pat. Off. .
0591683 4/1994 European Pat. Off. .
0592801 4/1994 European Pat. Off. .

*Primary Examiner*—Xiao Wu
*Attorney, Agent, or Firm*—Fitzpatrick, Cella, Harper & Scinto

[57] ABSTRACT

A display controller for outputting display data stored in a display memory to a display includes an address memory for storing an address, subjected to a write access, of the display memory, and a reciprocal number memory for storing a reciprocal number, calculated by a reciprocal calculator, of the number of display pixels of one horizontal line on the screen. A multiplier multiplies the address stored in the address memory with the reciprocal number calculated by the reciprocal calculator, and a horizontal line number determinator obtains a display line number of the screen on the basis of a multiplication result by the multiplier.

28 Claims, 25 Drawing Sheets

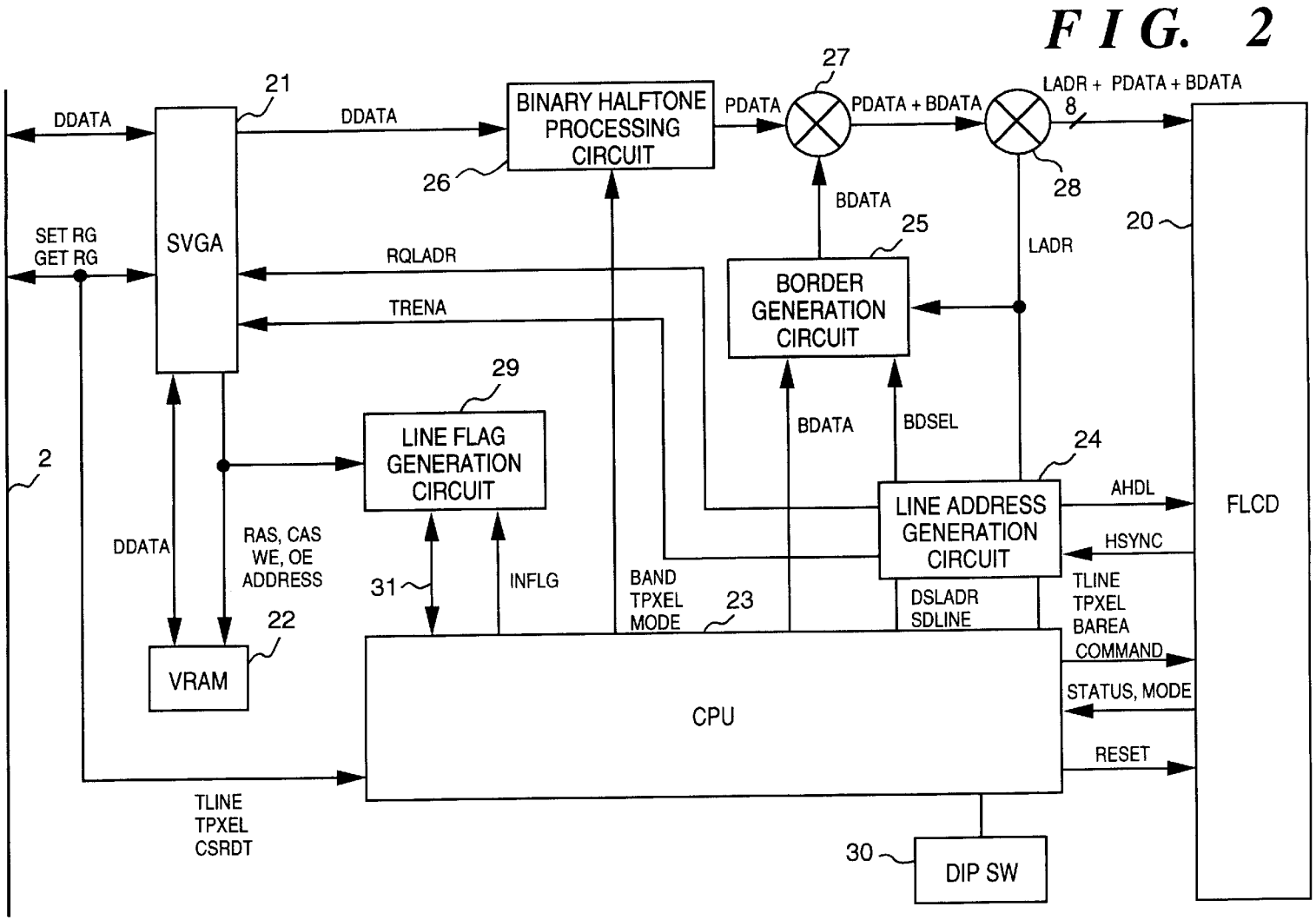
FIG. 2
FLCD
20
LADR + PDATA + BDATA
8
28
LADR
PDATA + BDATA
27
PDATA
BDATA
25
BORDER GENERATION CIRCUIT
BDSEL
BDATA
24
LINE ADDRESS GENERATION CIRCUIT
AHDL
HSYNC
TLINE
TPXEL
BAREA
COMMAND
STATUS, MODE
RESET
DSLADR
SDLINE
CPU
23
DIP SW
30
BAND
TPXEL
MODE
BINARY HALFTONE PROCESSING CIRCUIT
26
RQLADR
TRENA
LINE FLAG GENERATION CIRCUIT
29
INFLG
31
DDATA
21
SVGA
RAS, CAS
WE, OE
ADDRESS
22
VRAM
DDATA
TLINE
TPXEL
CSRDT
DDATA
SET RG
GET RG
2

2910
DECODER
2909
DIVIDER
202
2912
HORIZONTAL LINE NUMBER REGISTER
2913
FLAG REGISTER
INFLG
201
2908
SUBTRACTER
2911
SSA REGISTER
RE
WE
DATA
31 : TO CPU 23
2907
20
CAS
ADDRESS
CASH
WEH
ADDRESS LATCH CIRCUIT
CAS
WE
RAS
29
9
2905
2904
2901
2903
2902
CAS
WE
ADDRESS
CAS1
CAS0
WE7
WE6
WE5
WE4
WE3
WE2
WE1
WE0
RAS

DISPLAY CONTROL METHOD AND DISPLAY CONTROLLER AND DISPLAY APPARATUS USING THE SAME

BACKGROUND OF THE INVENTION

The present invention relates to a display control method and display controller for displaying data stored in a display memory on a display, and a display apparatus using the same.

As a display apparatus for, e.g., computer equipment, a CRT display device is known. However, since the CRT display device requires a large length in the direction of thickness of the display screen, the entire volume becomes large, and it is difficult to attain a size reduction of the entire system. In a display control of such a CRT display apparatus, display data must always be refreshed using, e.g., a CRT controller (CRTC), resulting in complicated display control.

As displays which can compensate for the drawbacks of the conventional CRT display apparatus, liquid crystal displays, which can attain a size reduction of the display apparatus, in particular, a low-profile structure, are known. Of these liquid crystal displays, a ferroelectric liquid crystal (FLC) has memory characteristics that can maintain an aligned state after an electric field is removed. A display controller for the FLC display (FLCD) need not always refresh the screen unlike in the CRT display controller. In addition, when a display image is changed, the display controller can display the entire changed image by changing only display data of the display corresponding to a portion where the contents of a display memory are changed.

When data is to be displayed on such an FLCD, the refresh period of the display screen can be prolonged unlike a CRT or other displays, thus assuring a sufficient time margin. In addition to refresh control, the display controller for the FLCD requires so-called partial rewrite control for updating display data of only a portion corresponding to a change in image on the display screen. The partial rewrite control is characterized in that it is performed in units of horizontal lines, and is discontinuous in the vertical direction of the display screen.

Upon execution of the partial rewrite control, when the display controller for the FLCD receives a data request signal from the FLCD, it performs a display operation by outputting display data (pixel data) to be displayed and its line address(es) in response to the data request signal. For this reason, when the contents of the display memory have been updated, the display controller must determine line address(es) of the display screen corresponding to the updated portion so as to partially rewrite display data, and must acquire and output the line address to the FLCD.

As a method of determining the line address(es) on a display screen corresponding to the address(es) where the contents of the display memory have been changed, the address may be input to a table comprising, e.g., a RAM, and the corresponding display line address (number) may be output. However, when the address space of the display memory is to be changed in correspondence with the volume of data to be displayed on the FLCD, the change in contents of the display memory cannot be coped with, since a correspondence between the addresses on the display memory and the display lines is not constant. For this reason, when the table is used, the memory space of the display memory must always be fixed.

SUMMARY OF THE INVENTION

The present invention has been made in consideration of the above-mentioned prior art, and has as its object to provide a display control method and display controller which can determine the corresponding display line at high speed, based on the address where the contents of a display memory have been updated, and a display apparatus using the same.

It is another object of the present invention to provide a display control method and display controller which can determine display line corresponding to the address where the contents of a display memory have been changed, and can display an entire image by updating only the changed data, and a display apparatus using the same.

It is still another object of the present invention to provide a display control method and display controller which can easily determine display line corresponding to the address where the contents of a display memory have been changed, even when the capacity of a display memory is changed, and a display apparatus using the same.

It is still another object of the present invention to provide a display control method and display controller which can constitute an economic display system by changing the capacity of a display memory in correspondence with the display contents, and a display apparatus using the same.

It is still another object of the present invention to provide a display control method and display controller which can determine display line of a display corresponding to an address of a display memory in which display data is updated and can display an entire image by updating only display data corresponding to the display line even when the capacity of the display memory is changed, and a display apparatus using the same.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 1 is a block diagram showing the entire information processing system which uses an FLC display apparatus comprising a display controller according to an embodiment of the present invention as a display apparatus for displaying various kinds of characters, image information, and the like;

FIG. 2 is a block diagram showing the arrangement of an FLCD interface unit of the display controller of an embodiment;

DESCRIPTION OF THE PREFERRED EMBODIMENTS

The preferred embodiments of the present invention will be described in detail hereinafter with reference to the accompanying drawings.

Figure 1:
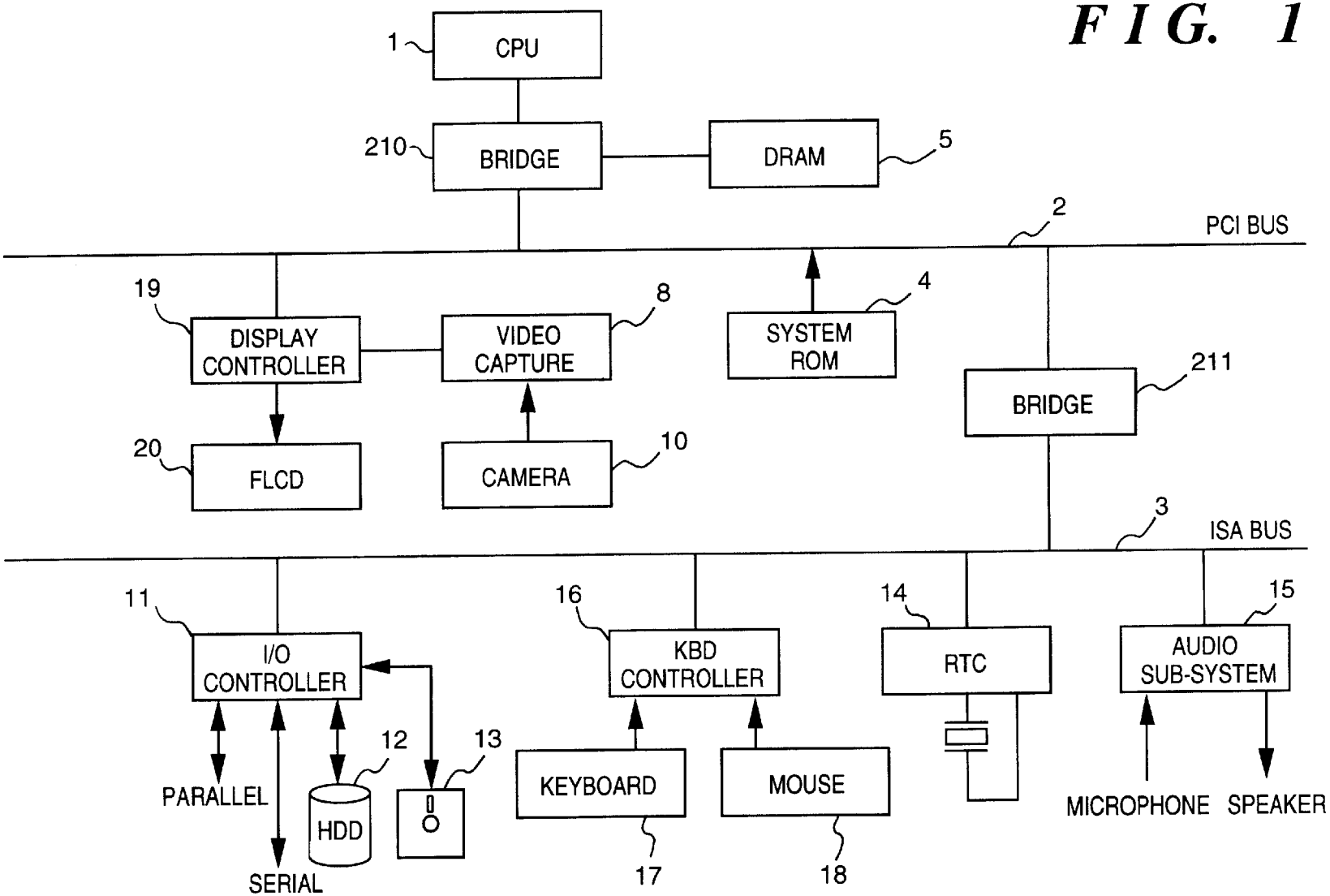

FIG. 1 is a block diagram showing the entire information processing system which uses an FLC display apparatus according to an embodiment of the present invention as a display apparatus for displaying various kinds of characters, image information, and the like.

Referring to FIG. 1, reference numeral 1 denotes a host CPU for controlling the entire information processing system of this embodiment; 210, a bridge for interfacing between the CPU 1 and a high-speed bus (PCI bus) 2; and 5, a DRAM which is used as a main memory. The DRAM 5 stores a control program to be executed by the CPU 1, and is used as a work area in control processing of the CPU 1. The high-speed bus (PCI bus) 2 comprises an address bus, a control bus, a data bus, and the like. Reference numeral 3 denotes a middle-speed bus (e.g., an ISA bus). The high- and middle-speed buses 2 and 3 are connected via a bridge 211. Reference numeral 4 denotes a system ROM storing, e.g., a program for performing initialization processing of the entire system. Reference numeral 19 denotes a display controller (FLCD interface unit), which attains interface control with an FLCD 20 and interface control with a video capture 8. Reference numeral 10 denotes an image scanner, a camera, or the like for reading an image or the like.

Portions connected to the middle-speed bus (ISA bus) 3 will be explained below. Reference numeral 11 denotes an I/O controller which comprises a parallel or serial interface and also has a disk interface function for a hard disk device 12 and a floppy disk device 13. Reference numeral 16 denotes a keyboard (KBD) controller which controls interfaces with a keyboard 17 used for inputting characters such as letters, numerals, and the like, and a mouse 18 serving as a pointing device. Reference numeral 14 denotes a real-time clock which also has a timer function of measuring a time by counting clocks. Reference numeral 15 denotes an audio sub-system, which receives an audio signal from a microphone and outputs it onto the middle-speed bus 3, or drives a loudspeaker on the basis of a signal from the bus 3 to output an audible signal. Note that the FLCD 20 is an FLCD (FLC display) constituted by using a display disclosed in, e.g., U.S. Pat. No. 4,922,241 by the present applicant.

In the information processing system with the above-mentioned arrangement, a system user makes operations in correspondence with various kinds of information displayed on the display screen of the FLCD 20. More specifically, character or image information supplied from the parallel or serial interface, the hard disk device 12, the floppy disk device 13, the keyboard 17, or the pointing device 18, operation information associated with the user's system operation and stored in the system ROM 4 or the main memory (DRAM) 5, or the like is displayed on the display screen of the FLCD 20, and a user performs an edit operation of the information or an instruction operation to the system while observing the displayed information. Note that the above-mentioned respective portions can supply display information to the FLCD 20.

FIG. 2 is a block diagram showing the arrangement of the FLCD interface unit 19 of this embodiment.

As shown in FIG. 2, the FLCD interface unit 19 of this embodiment, i.e., the display controller, adopts an SVGA 21 which utilizes an existing SVGA as a display control circuit for a CRT. Prior to a description of the arrangement shown in FIG. 2, the arrangement of the SVGA 21 of this embodiment will be described below with reference to FIG. 3.

Figure 3:
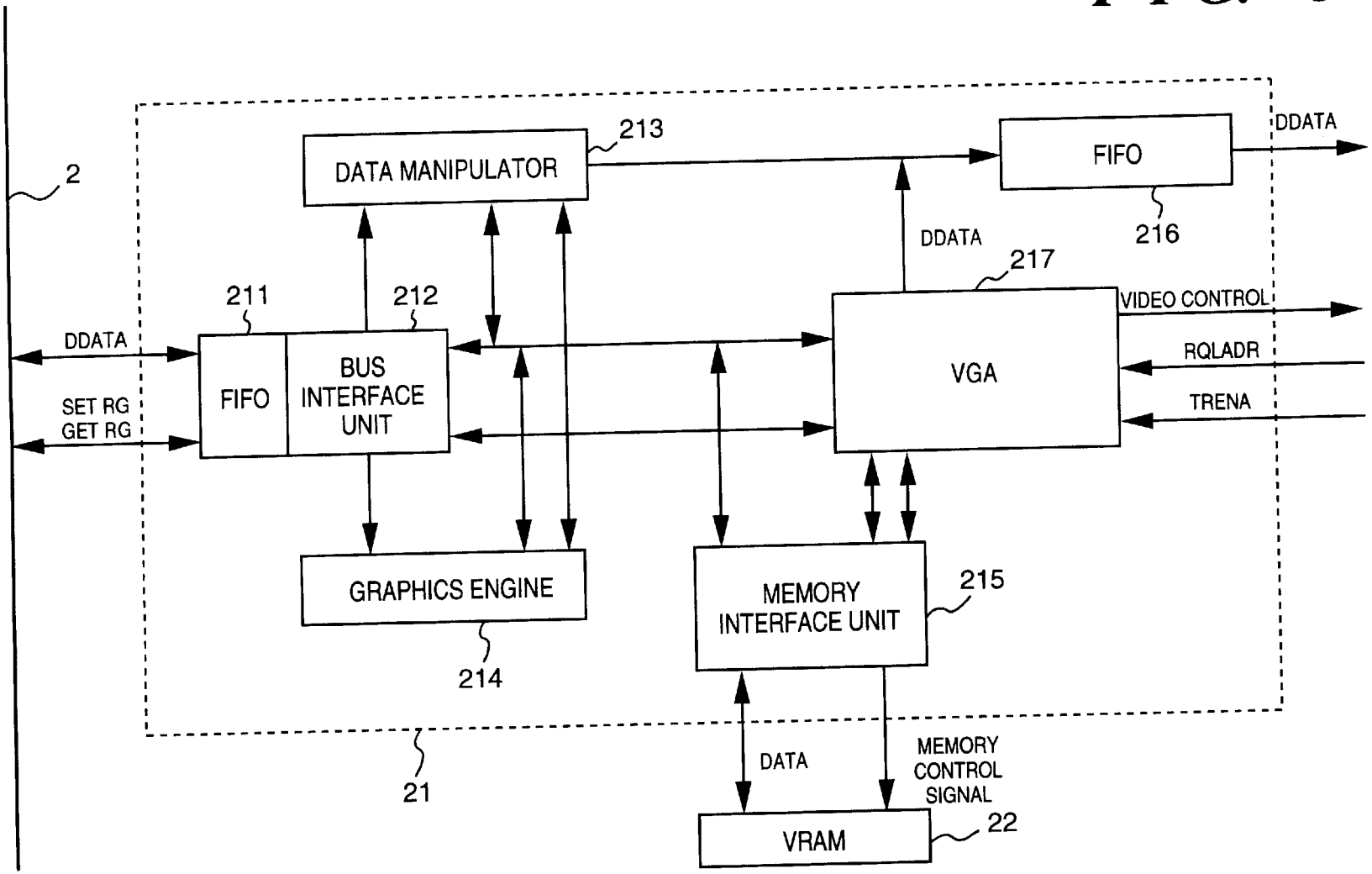
FIG. 3 is a block diagram showing the arrangement of an SVGA of the embodiment.

FIG. 3 is a block diagram showing the arrangement of the SVGA 21 of this embodiment.

Referring to FIG. 3, display data (DDATA), which is display data of an area, corresponding to a display window on the FLCD 20, of the display memory (DRAM 5) and is displayed while being rewritten, is transferred to the FLCD interface unit 19 via the PCI bus 2 under the control of the host CPU 1, and is temporarily stored in a FIFO 211. Also, bank address data used for projecting the area, corresponding to the display window, of the display memory onto an arbitrary area of a VRAM 22 is also transferred to the FLCD interface unit 19 via the PCI bus 2.

Commands, the above-mentioned bank address data, and the like, and control information from the host CPU 1 are transferred to the SVGA 21 in the form of register set data (SETRG), and register get data (GETRG) is transferred from the SVGA 21 to the host CPU 1 (see FIG. 2) so that the host CPU 1 detects the state of the SVGA 21. The register set data (SETRG) and the display data (DDATA) stored in the FIFO 211 are sequentially output from the FIFO 211, and are set in corresponding registers in a bus interface unit 212 and a VGA 217 in correspondence with their types. The VGA 217 can detect the bank address, its display data, a control command, and the like on the basis of the set state of data in these registers.

The VGA 217 generates a VRAM address on the VRAM 22 on the basis of an address on the area, corresponding to the display window, of the display memory (DRAM 5) and the bank address. Together with the generated address data, the VGA 217 transfers strobe signals RAS and CAS, a chip select signal CS, and a write enable signal WE as memory control signals to the VRAM 22 via a memory interface unit 215. With these control signals, display data can be written at the address on the VRAM 22 designated by the VRAM address. At this time, display data to be written is also transferred to the VRAM 22 via the memory interface unit 215.

On the other hand, the VGA 217 reads out the display data (DDATA) stored in the VRAM 22 specified by a request line address (RQLADR) transferred from a line address generation circuit 24 (to be described later) from the VRAM 22 in accordance with a line data transfer enable signal (TRENA) similarly transferred from the line address generation circuit 24, and stores the readout data in a FIFO 216. The FIFO 216 sends the display data (DDATA) to the FLCD 20 in their storage order.

The SVGA 21 also comprises a data manipulator 213 and a graphics engine 214 which serve as an accelerator function. For example, when the host CPU 1 sets data associated with a circle, and its center and radius in the registers of the bus interface unit 212 and instructs drawing of the circle, the graphics engine 214 generates display data for drawing the circle, and the data manipulator 213 can write the generated data in the VRAM 22 via the memory interface unit 215.

Referring back to FIG. 2, a CPU 23 reads the contents of a flag register 2913 (FIG. 4) of a line flag generation circuit 29 (to be described later with reference to FIG. 4), and sends a request line address (RQLADR) set with a flag to the SVGA 21 via the line address generation circuit 24. At this time, the line address generation circuit 24 sends a line data transfer enable signal (TRENA) in correspondence with the line address data. With these signals, the SVGA 21 (i.e., its FIFO 216) transfers display data (DDATA) at the designated line address to a binary halftone processing circuit 26.

Figure 5:
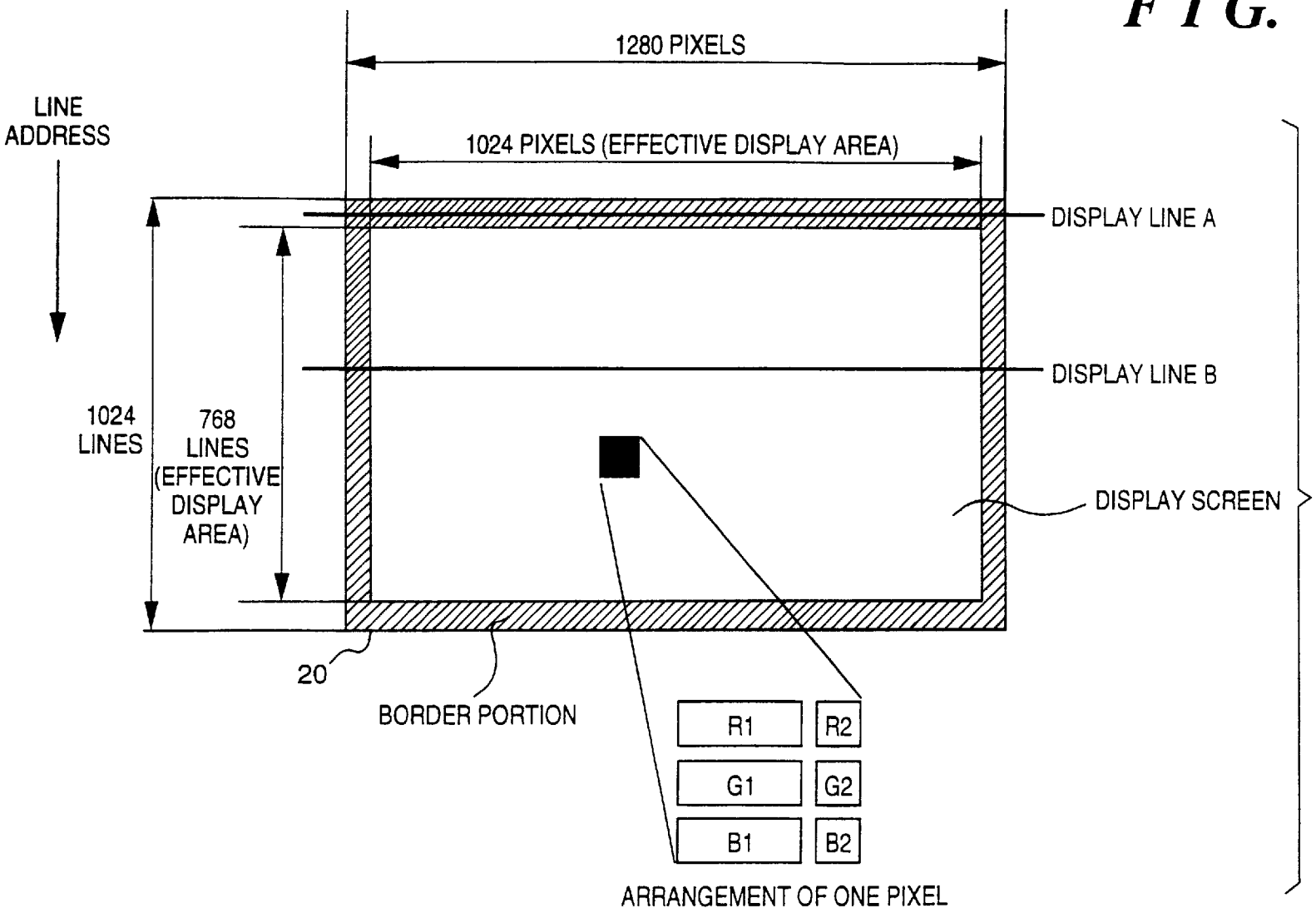
FIG. 5 is a view showing an example of the display screen of an FLCD of the embodiment.

The binary halftone processing circuit 26 converts multi-value display data (DDATA) expressed by R, G, and B data (5 bits each, a total of 15 bits: 32K colors), or R (3 bits), G (3 bits), and B (2 bits) data (a total of 8 bits: 256 colors), or R, G, B, and I (luminance) data (1 bit each, a total of 4 bits: 16 colors) into binary pixel data (PDATA) corresponding to each pixel on the display screen of the FLCD 20. In this embodiment, one pixel on the display screen has display cells having different areas corresponding to R, G, and B colors, as shown in FIG. 5. As shown in FIG. 5, the FLCD 20 has a maximum of 1,280 pixels (horizontal direction)× 1,024 lines (vertical direction) display area, and a 1,024 pixels×768 lines area of this display area except for a border portion indicated by a hatched portion corresponds to an effective display area.

Figure 6A:
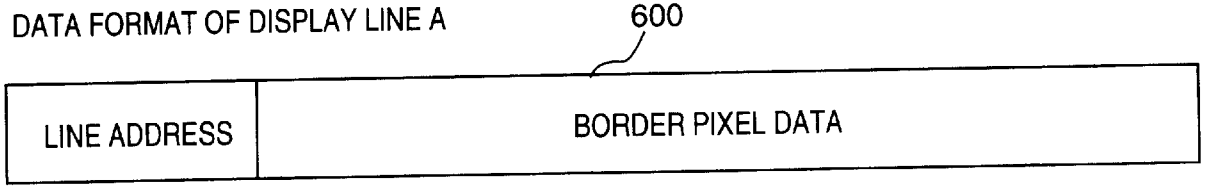
FIGS. 6A and 6B are views showing an example of the data format of a display line shown in FIG. 5.
Figure 6B:
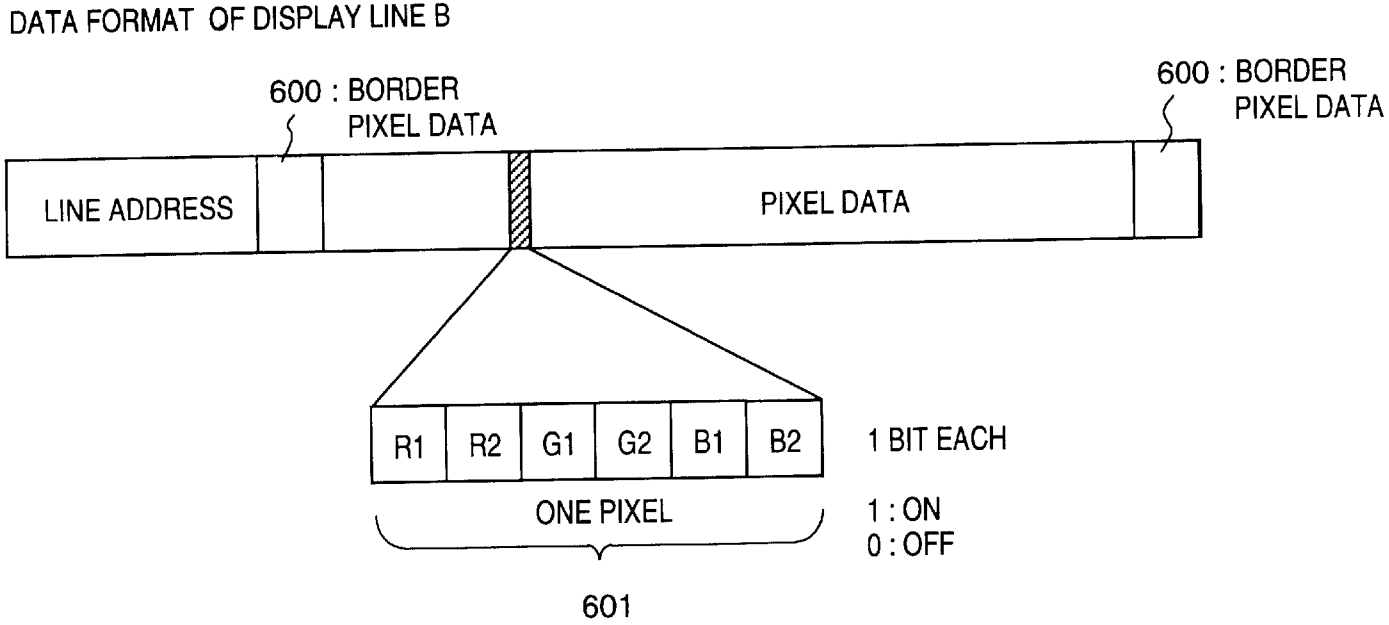

FIGS. 6A and 6B show the data formats of display lines A and B shown in FIG. 5. FIG. 6A shows the data format of the display line A. In this format, the line address is assigned to the beginning of data, and a pixel data portion of the display line includes only border pixel data 600. FIG. 6B shows the data format of the display line B. In this format, the two end portions of the pixel data portion include border pixel data 600, and pixel data to be actually displayed are interposed therebetween. One pixel data to be displayed has 2 bits (R1 and R2, G2 and G2, B1 and B2, respectively) for each of R, G, and B colors, as denoted by 601 in FIG. 6B. Therefore, the binary halftone processing circuit 26 converts a total of 15-, 8-, or 4-bit R, G, and B display data per one pixel into 2-bit data per R, G, or B color component (e.g., each of R, G, and B colors is expressed by 4-value data).

Note that this binary halftone processing can use a known method. For example, an error diffusion method, an average density method, a dither method, or the like may be used.

Referring back to FIG. 2, a border generation circuit 25 generates border pixel data (BDATA) of the border portion on the display screen of the FLCD 20. More specifically, as shown in FIG. 5 above, the display screen of the FLCD 20 has 1,024 lines each having 1,280 pixels, and of this display screen, the border portion (hatched portion) which is not used for a display is formed to border the display screen. The border pixel data (BDATA) generated by the border generation circuit 25 is serially synthesized with the pixel data (PDATA) from the binary halftone processing circuit 26 by a synthesizing circuit 27. Furthermore, thereafter, the synthesizing circuit 28 synthesizes the synthesized data with display line address data (LADR) from the line address generation circuit 24, and supplies the synthesized data to the FLCD 20. Note that pattern data (BDATA) of the border portion is instructed by the CPU 23.

Figure 7:
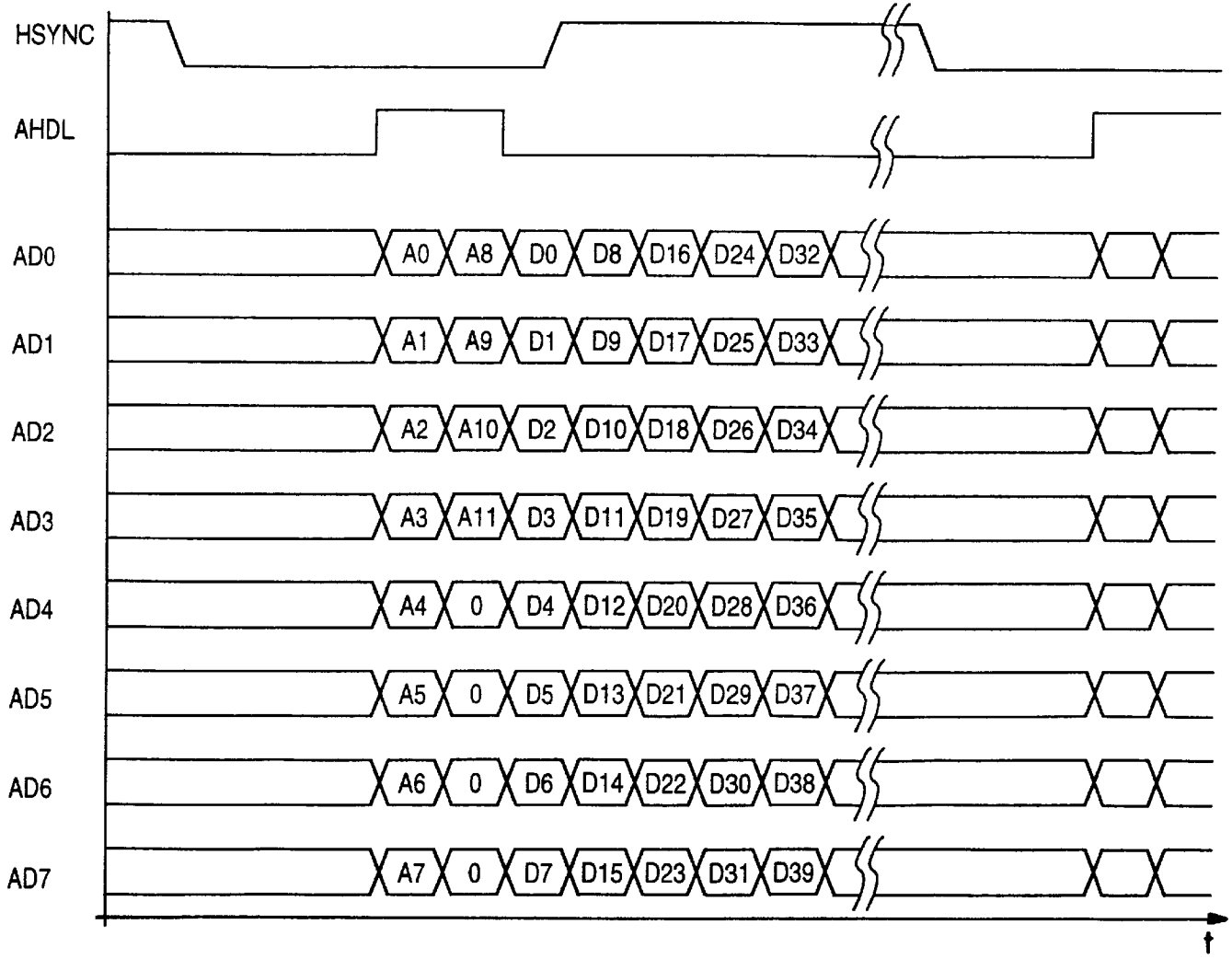
FIG. 7 is a timing chart showing the transfer timings of the display line address and pixel data to the FLCD.

FIG. 7 is a timing chart showing the transfer timings of the display line address (LADR) and pixel data (PDATA+ BDATA) to the FLCD 20. In this embodiment, the display line addresses and pixel data are transferred to the FLCD 20 in the form of 8-bit parallel data AD0 to AD7.

When a synchronization signal HSYNC indicating a transmission request of data from the FLCD 20 is input to the line address generation circuit 24, the line address generation circuit 24 sends request line addresses (RQLADR) indicating lines to be displayed to the SVGA 21, on the basis of a display start line address (DSLADR) and the number (SDLINE) of lines to be successively displayed, DSLADR and SDLINE are designated by the CPU 23 in advance. With these data, the SVGA 21 outputs display data (DDATA) corresponding to the input addresses. At the same time, the line address generation circuit 24 sets a signal AHDL for discriminating the display line address and pixel data at high level "1", and outputs it to the FLCD 20. In addition, the circuit 24 transfers display line addresses (LADR: A0 to A11) to the FLCD 20. Upon completion of the transfer of the display line addresses (LADR) to the FLCD 20, the line address generation circuit 24 sets the signal AHDL at low level "0" and outputs it to the FLCD 20. In addition, the pixel data (PDATA+BDATA) supplied from the SVGA 21 via the binary halftone processing circuit 26 and the synthesizing circuit 27 are transferred to the FLCD 20. When the signal AHDL is at high level "1", it indicates that the display line addresses (LADR) are output onto signal lines AD0 to AD7; when the signal AHDL is at low level, it indicates that pixel data are output onto the signal lines AD0 to AD7.

The CPU 23 controls the entire FLCD interface unit 19 described above. More specifically, the CPU 23 receives information such as the total number (TLINE) of lines of the display screen, the total number (TPXEL) of pixels as the number of display pixels per line, cursor information (CSRDT), and the like. The CPU 23 sends data such as VRAM address offset data, the total number (TLINE) of lines to be displayed, and the total number (TPXEL) of pixels to be displayed to the line flag generation circuit 29 via a signal line 31. The CPU 23 initializes the partially rewritten line flag register 2913 arranged in the line flag generation circuit 29 using a signal INFLG, sends the display start line address (DSLADR), the number (SDLINE) of lines to be successively displayed, the total number (TLINE) of lines, the total number (TPXEL) of pixels, and various data indicating the border area (BAREA) to the line address generation circuit 24, and acquires partially rewritten line flag information from the line flag generation circuit 29 via the signal line 31. Furthermore, the CPU 23 sends data such as a bandwidth (BAND), the total number (TPXEL) of pixels, and a processing mode (MODE) to the binary halftone processing circuit 26, and sends border pattern data (BDATA) to the border generation circuit 25. Reference numeral 30 denotes, e.g., a 2-bit DIP switch, which instructs the arrangement of the memory block of the VRAM 22 to the CPU 23. This switch will be described in detail later in the description of the arrangement of the line flag generation circuit 29.

<Line Flag Generation Circuit 29>

Figure 4:
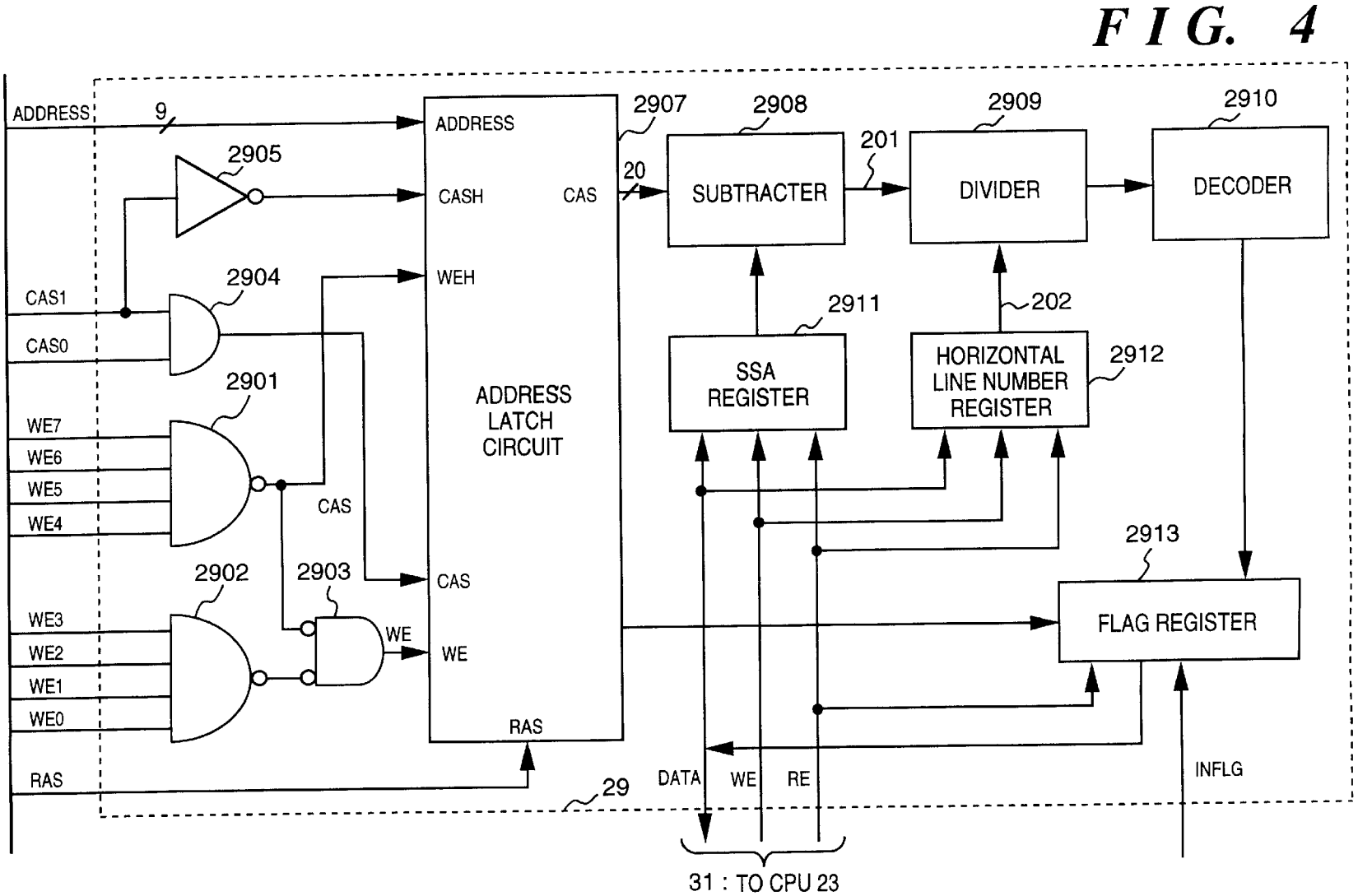
FIG. 4 is a block diagram showing the arrangement of a line flag generation circuit of the embodiment.

FIG. 4 is a block diagram showing the arrangement of the line flag generation circuit 29 of this embodiment.

Referring to FIG. 4, reference numeral 2907 denotes an address latch circuit for generating 20-bit address data on the basis of an address signal output. The latch timing of this address signal is determined based on signals RAS*, CAS<1:0>*, and WE<7:0>* upon generation of the write operation to the VRAM 22 by the SVGA 21. Note that * indicates a signal of active low, and <a:b> of the signals CAS<1:0>* and WE<7:0>* indicates signals a to b. For example, the signal WE<7:0>* indicates signals WE0* to WE7*. Note that display data to be displayed on the FLCD 20 are stored in the order from address 0 of the VRAM 22 in correspondence with positions from the upper left corner to the lower right corner of the display screen of the FLCD 20.

A subtracter 2908 subtracts the value of an SSA (Screen Start Address) register 2911 from the 20-bit address data generated and output from the address latch circuit 2907. Thereafter, the address data is divided by the number of addresses of the VRAM 22 corresponding to the horizontal resolution by a divider 2909 at the output side of the subtracter 2908, thereby calculating the rewritten line position. The role of these subtracter 2908 and SSA register 2911 will be explained below. When the beginning of data to be displayed on the FLCD 20 is not address 0 of the VRAM 22, the display start address is set in the SSA register 2911, and the value set in the SSA register 2911 can be subtracted from the address data from the address latch circuit 2907, thus obtaining the corresponding display line number. The obtained line number is sent to a decoder 2910, and is decoded to set corresponding flags of the flag register 2913. These flags can be read out by a signal RE from the CPU 23, and allow the CPU 23 to detect the line number where the display contents have changed. Note that the contents of the flag register 2913 are automatically reset after they are read out by the CPU 23.

Figure 8:
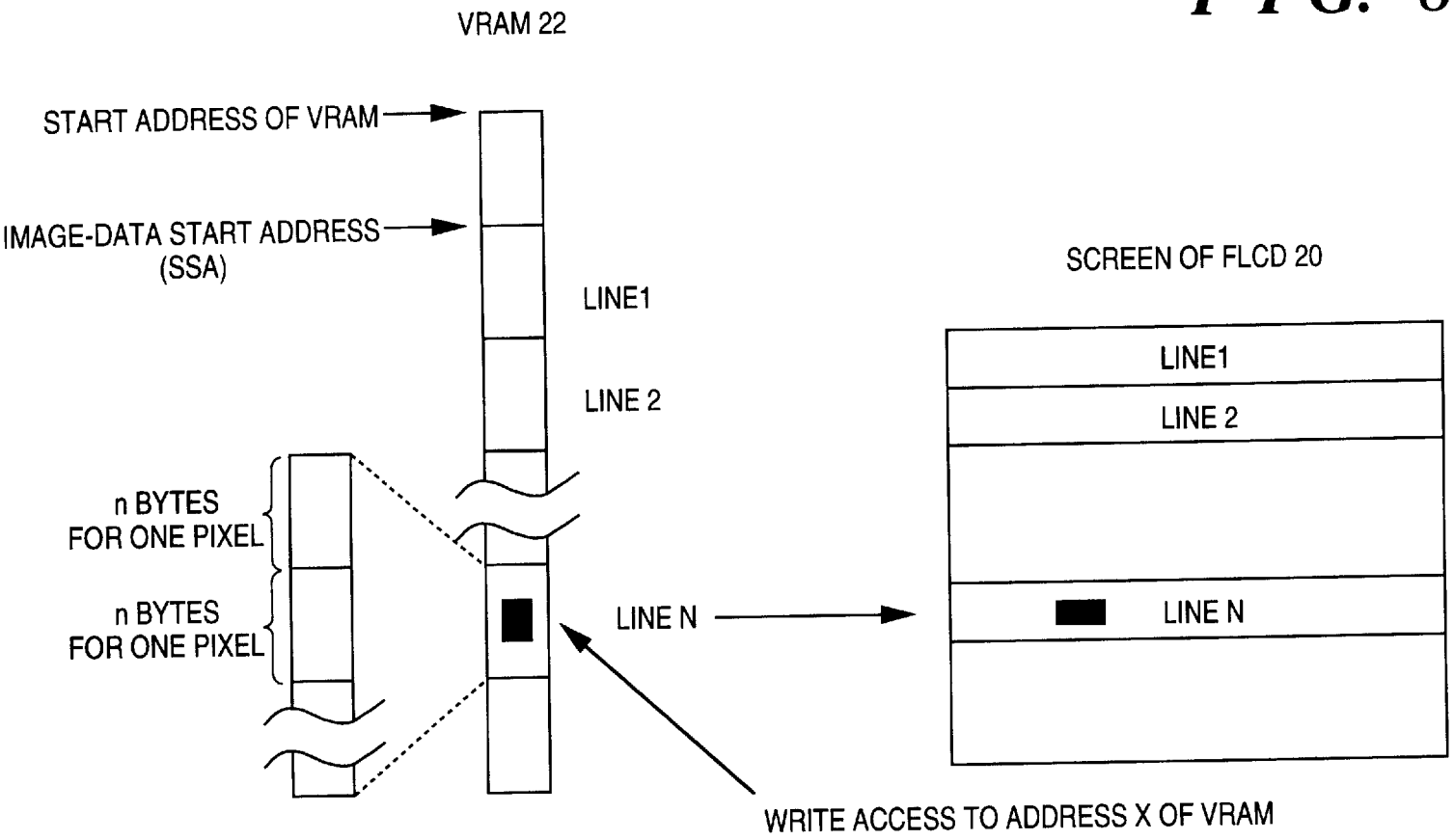
FIG. 8 is a view showing the correspondence between a pixel indicated by address X on a VRAM and the number N of display lines on the screen of the FLCD.

FIG. 8 shows the correspondence between a pixel indicated by address X on the VRAM 22 and the number N of display lines on the screen of the FLCD 20. Assume that one line includes a plurality of pixels, and one pixel has n bytes. At this time, the line address (line number N) of address X on the VRAM 22 is calculated as follows:

N=1+{(VRAM address: X)−(display start address)}/(the number of pixels per line)×(the number of bytes per pixel: n)

Figure 9:
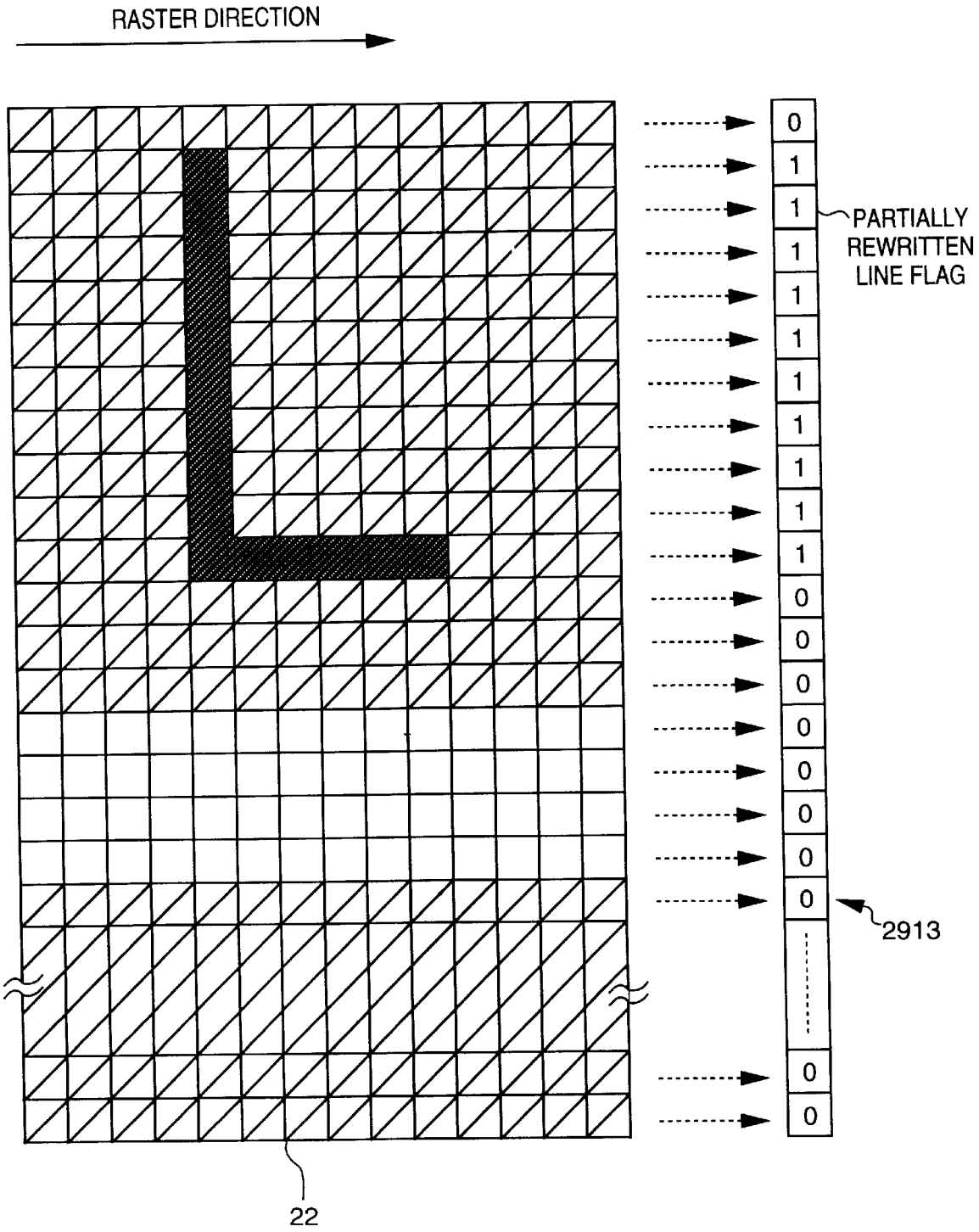
FIG. 9 is a view for explaining an example of flags to be set in a partial rewrite line flag register.

The line flag generation circuit 29 sets flags of the partially rewritten line flag register 2913 in correspondence with the calculated line address (N). FIG. 9 shows this state.

As can be seen from FIG. 9, when the display contents at corresponding addresses on the VRAM 22 are rewritten so as to display a letter "L", the rewritten line addresses are detected by the above-mentioned calculation, and flags corresponding to these addresses, of the register 2913 are set (to be "1").

The respective portions of the line flag generation circuit 29 will be described in turn below.

Figure 10:
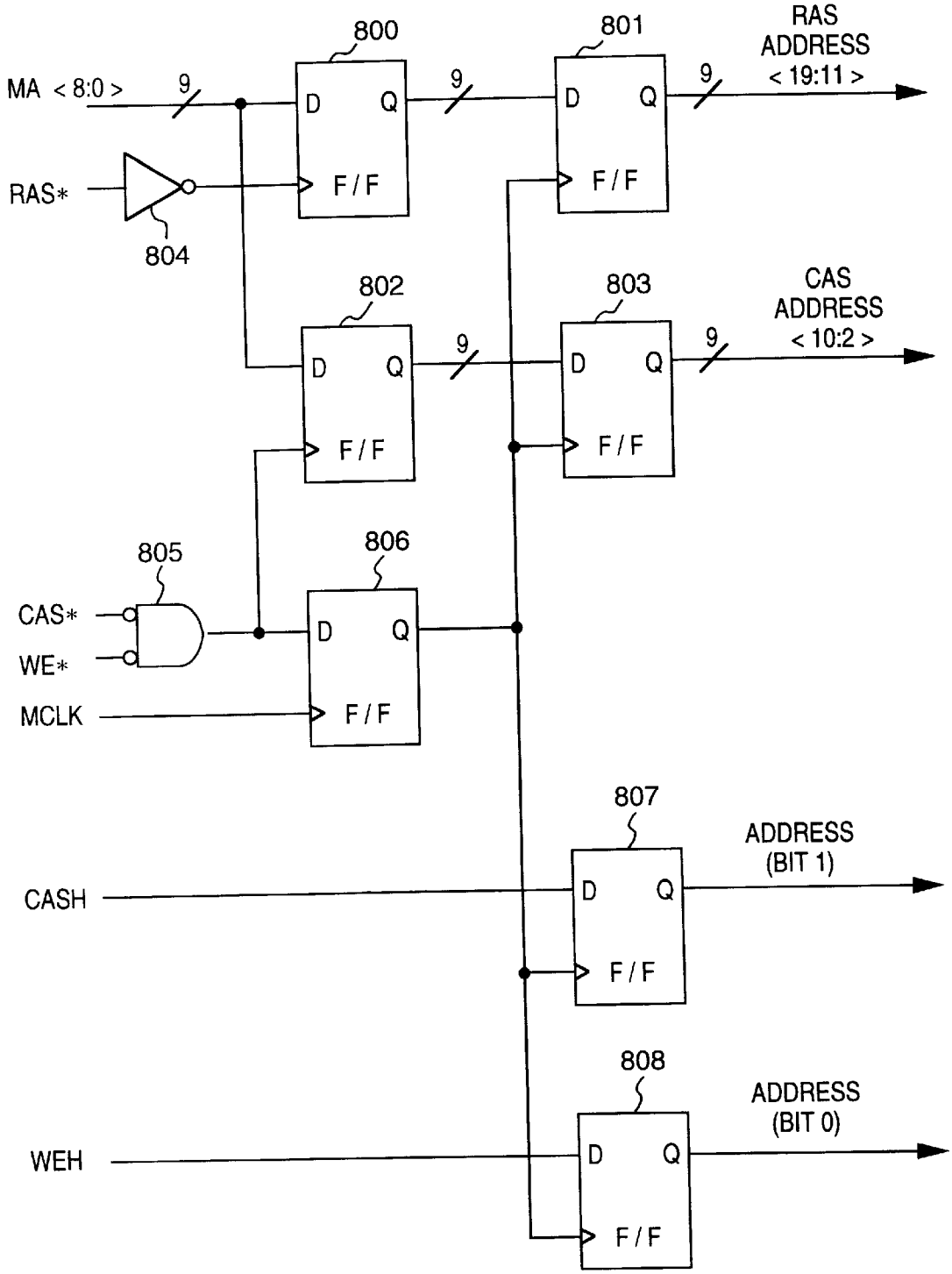
FIG. 10 is a circuit diagram showing the arrangement of an address latch circuit of the first embodiment.
Figure 11:
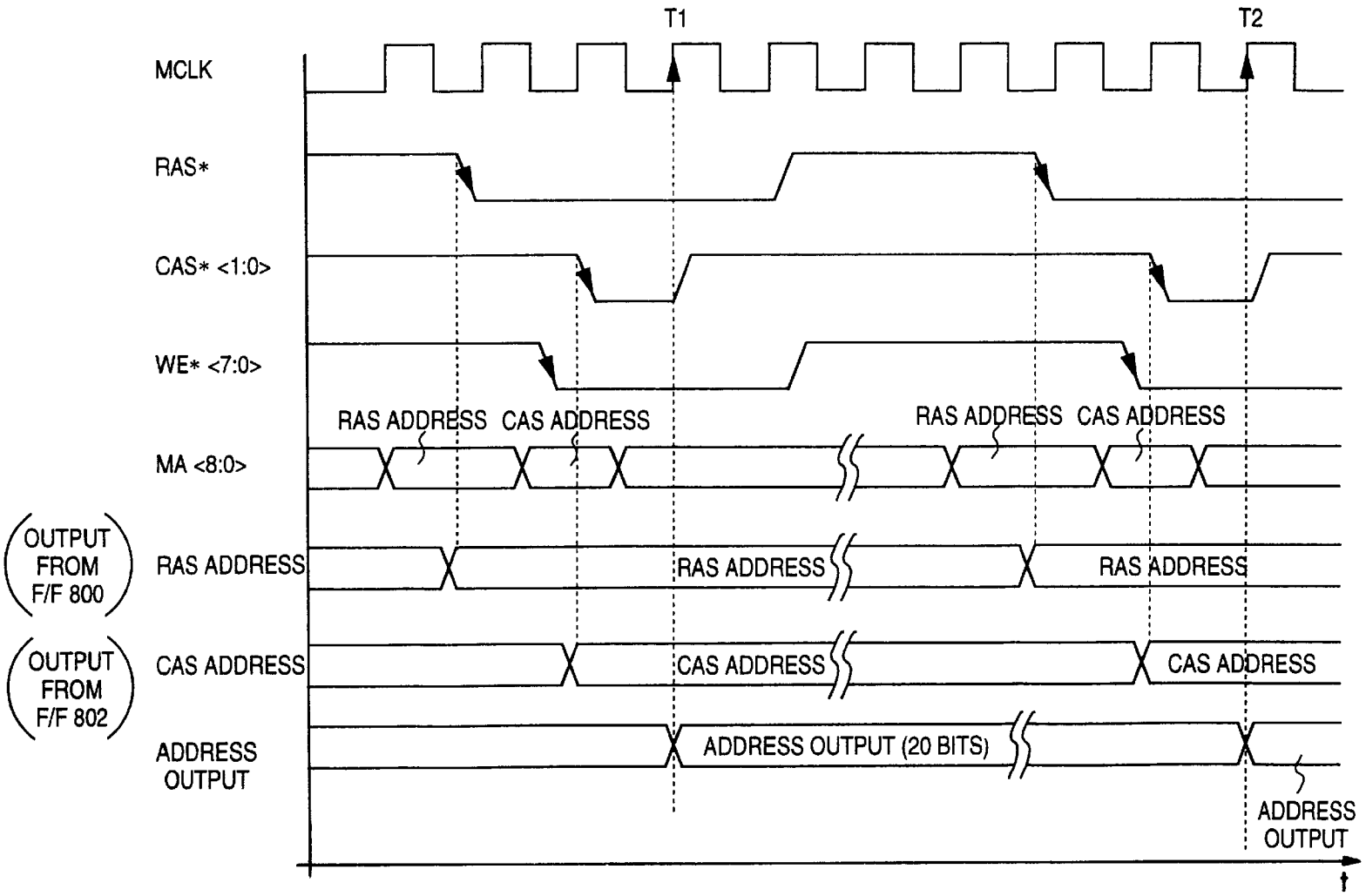
FIG. 11 is a timing chart showing the operation timing of the address latch circuit of the first embodiment.

FIG. 10 is a circuit diagram showing the circuit arrangement of the address latch circuit 2907 according to the first embodiment of the present invention, and exemplifies a case wherein the VRAM 22 has a fixed 4-Mbyte memory space. FIG. 11 is a timing chart showing the operation timing of this circuit.

Referring to FIG. 10, reference numerals 800 to 803 respectively denote 9-bit D-type flip-flops. The flip-flop 800 latches an RAS address, and the flip-flop 802 latches a CAS address. Flip-flops 806 to 808 are 1-bit flip-flops, respectively. The flip-flop 806 is set at timings T1 and T2 shown in FIG. 11, and the leading edge of its Q output determines the set timing of the flip-flops 801, 803, 807, and 808.

Figure 12A:
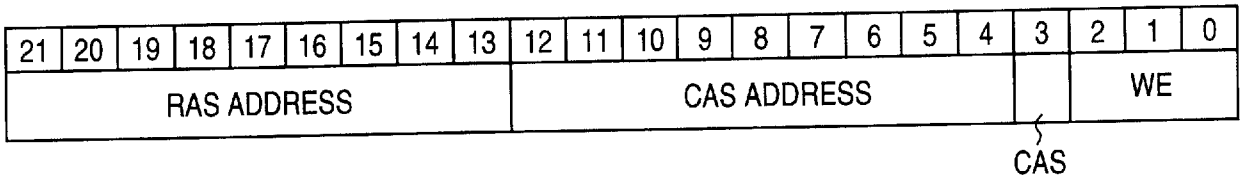
FIGS. 12A and 12B are views for explaining addresses generated by the address latch circuit when the VRAM is used as a 4-Mbyte memory.
Figure 12B:
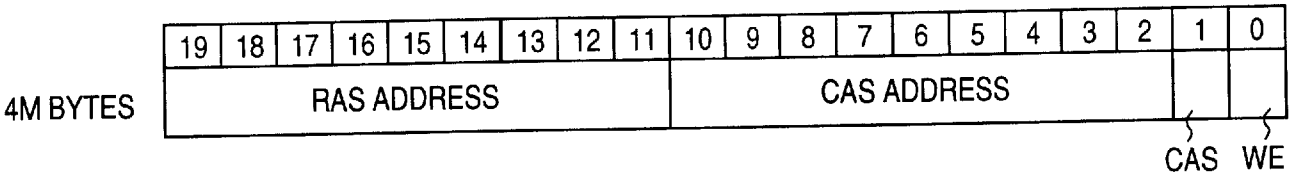

FIGS. 12A and 12B are views for explaining the format of the 20-bit address data generated by the address latch circuit 2907. FIG. 12A shows the VRAM addresses when the VRAM 22 has a 4-Mbyte address space, and one address of the VRAM 22 has 8 bits. In this case, the address data has 22 bits as a whole. FIG. 12B shows the 20-bit address data generated by the address circuit 2907 according to the first embodiment of the present invention. In this data, a signal WEH is set in bit 0, a signal CASH is set in bit 1, CAS address bits are set in bits 2 to 10, and RAS address bits are set in bits 11 to 19.

Figure 13:
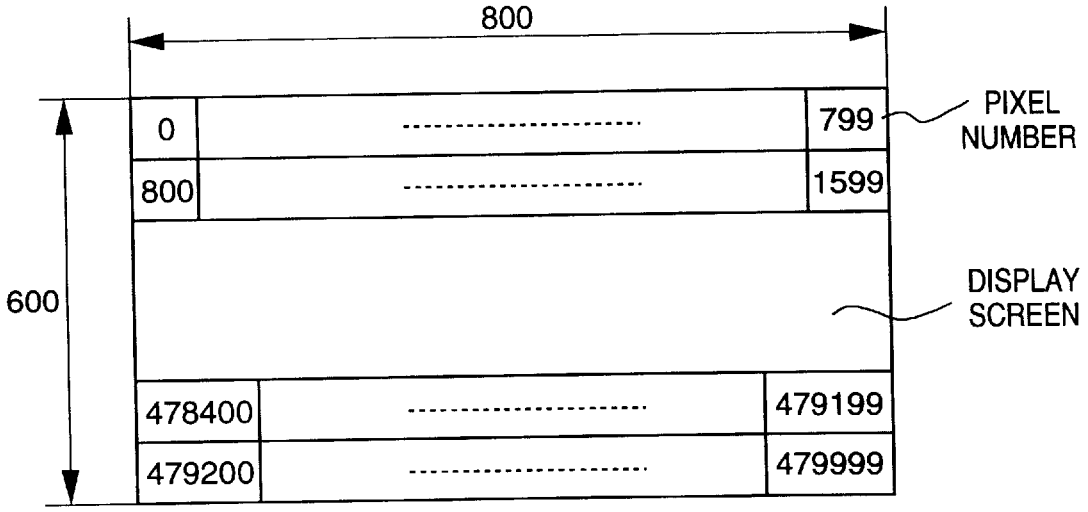
FIG. 13 is a view for explaining the correspondence between the display screen of the FLCD and the addresses of the VRAM.
Figure 14:
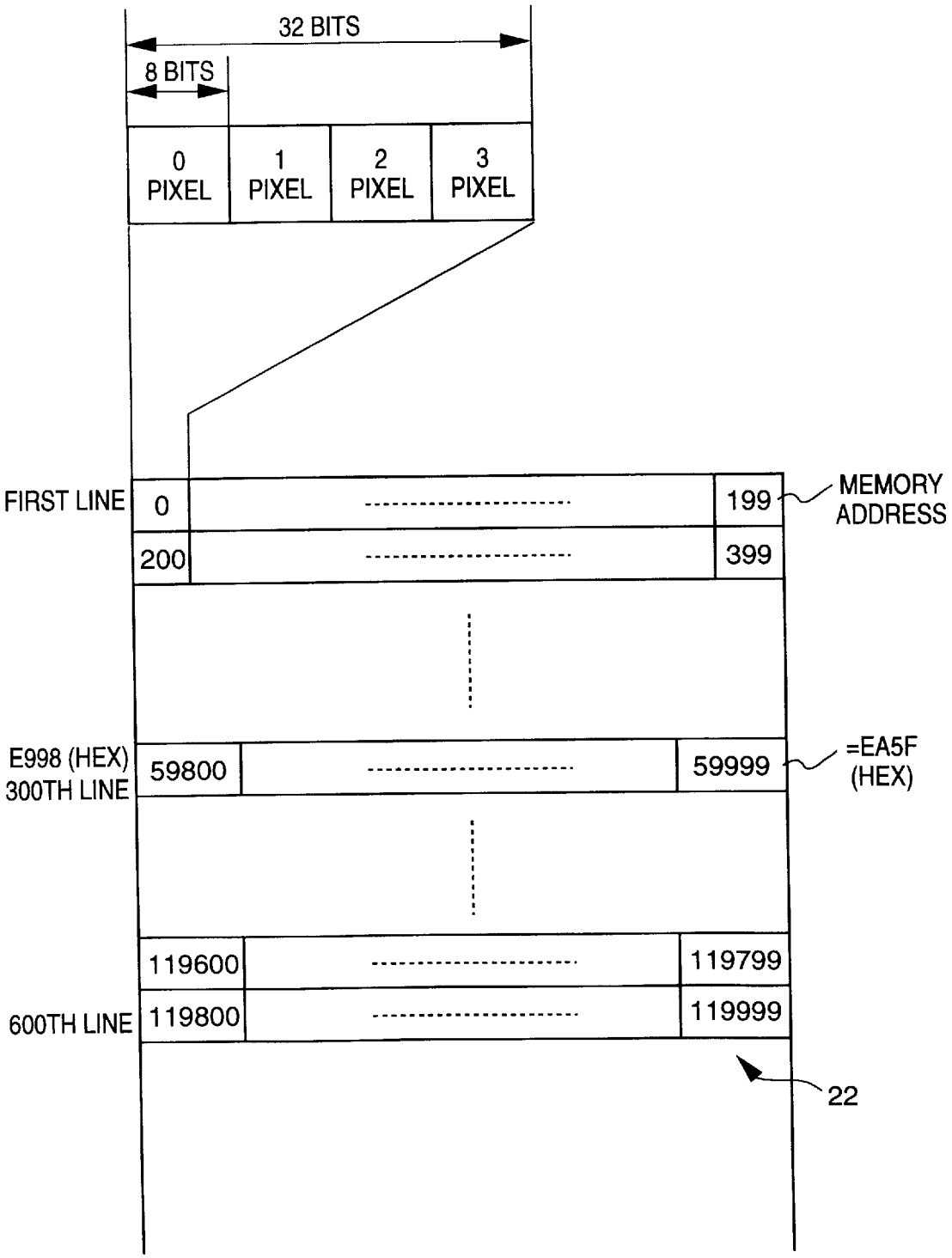
FIG. 14 is a view for explaining the correspondence between the display screen of the FLCD and the addresses of the VRAM.

FIGS. 13 and 14 show the relationship between the display area of the FLCD 20 and the addresses on the VRAM 22. FIG. 13 shows the display screen of the FLCD 20, and FIG. 14 shows the addresses on the VRAM 22 corresponding to the display area.

In this embodiment, assume that the effective display area of the FLCD 20 is defined by horizontal 800 pixels×vertical 600 pixels, one pixel has 8 bits (256 colors), and one address on the VRAM 22 has 32 bits (for four pixels). Therefore, the addresses on the VRAM 22 corresponding to one line on the display screen are 200 words.

The arrangement of the divider 2909 of the line flag generation circuit 29 will be described below. FIGS. 15 to 18 show the arrangement of the divider 2909 of this embodiment. Since the details of this divider 2909 have already been filed by the present applicant (Japanese Patent Laid-Open No. 6-180640), a brief explanation will be given below.

Figure 15:
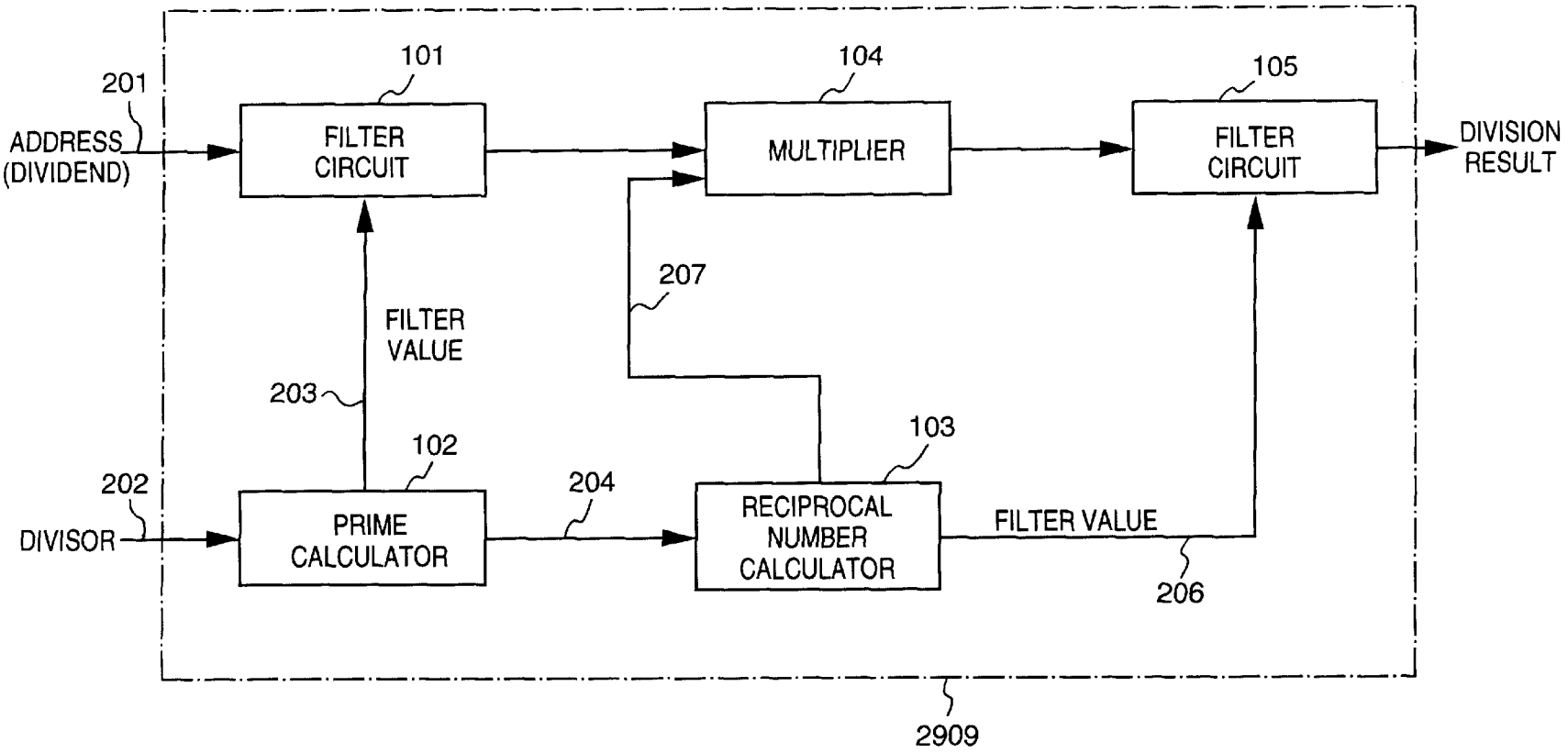
FIG. 15 is a block diagram showing the arrangement of a divider of the embodiment shown in FIG. 1.

FIG. 15 is a block diagram showing the overall arrangement of the divider 2909. The number of VRAM addresses (e.g., 200) corresponding to the horizontal resolution of the FLCD 20 is input as a divisor 202 from a horizontal line number register 2912 to the divider 2909, and a prime calculator 102 calculates the run of "0"s of lower bits. In addition, a reciprocal number calculator 103 calculates a reciprocal number 207 of the divisor 202. Address data (dividend: 20 bits) 201 input from the subtracter 2908 is input to a multiplier 104 via a filter circuit 101, and is multiplied with the reciprocal number 207 of the divisor (the number of horizontal lines). The calculation result is output as the division result via a filter circuit 105.

Figure 16:
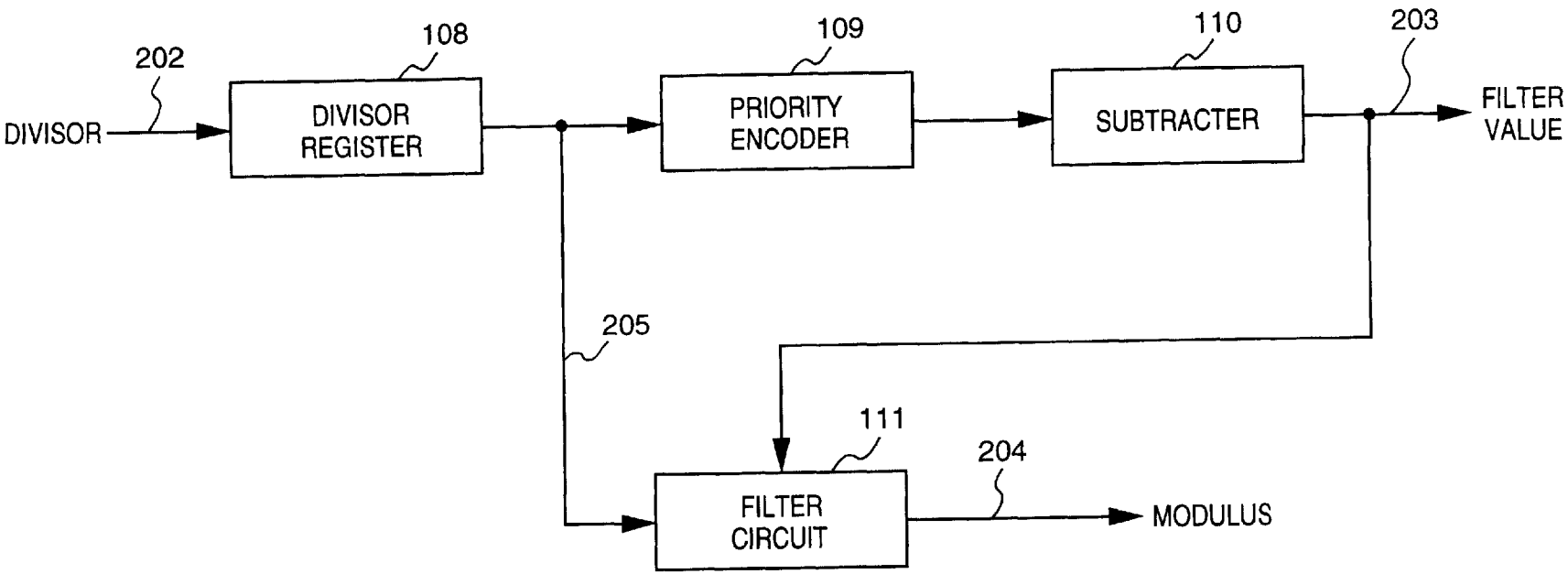
FIG. 16 is a block diagram showing the arrangement of a prime calculator.

FIG. 16 is a block diagram showing the arrangement of the prime calculator 102.

An input divisor (the number of horizontal lines) is set in a divisor register 108. For example, as shown in FIGS. 13 and 14, when the display screen of the FLCD 20 is defined by 800×600×256 colors, the number of horizontal VRAM addresses is "200" since one address corresponds to four pixels. Conversion of this value "200" into a 16-digit binary value yields "0000000011001000". A value "0001001100000000" obtained by inverting the 16-digit value is input to a priority encoder 109 to obtain "1100". This value is subtracted from "1111" by a subtracter 110, and "0011" is obtained as the subtraction result.

Figure 17:
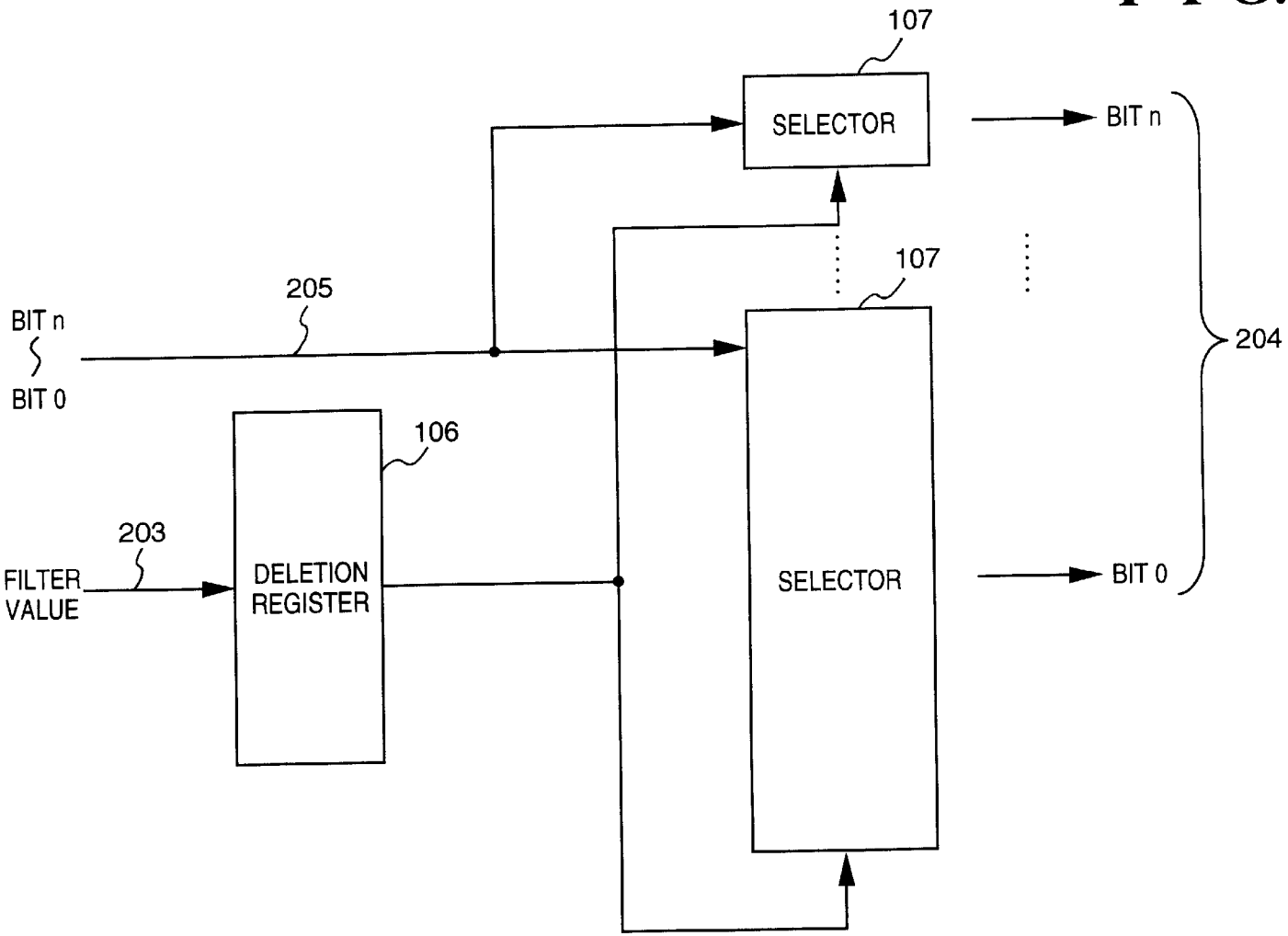
FIG. 17 is a block diagram showing the arrangement of a filter circuit 111.

FIG. 17 is a block diagram showing the arrangement of the filter circuit 111.

The filter circuit 111 receives, as a filter value 203, the value (e.g., 0011=3 in the above-mentioned case) calculated by the subtracter 110 based on the divisor 205 (0000000011001000) from the divisor register 108, and obtains a value "0000000000011001" by deleting lower 3 bits (="0011") using a deletion register 106. When this value is input as a modulus 204 to the following reciprocal number calculator 103 via a selector 107, its reciprocal number can be obtained.

Figure 18:
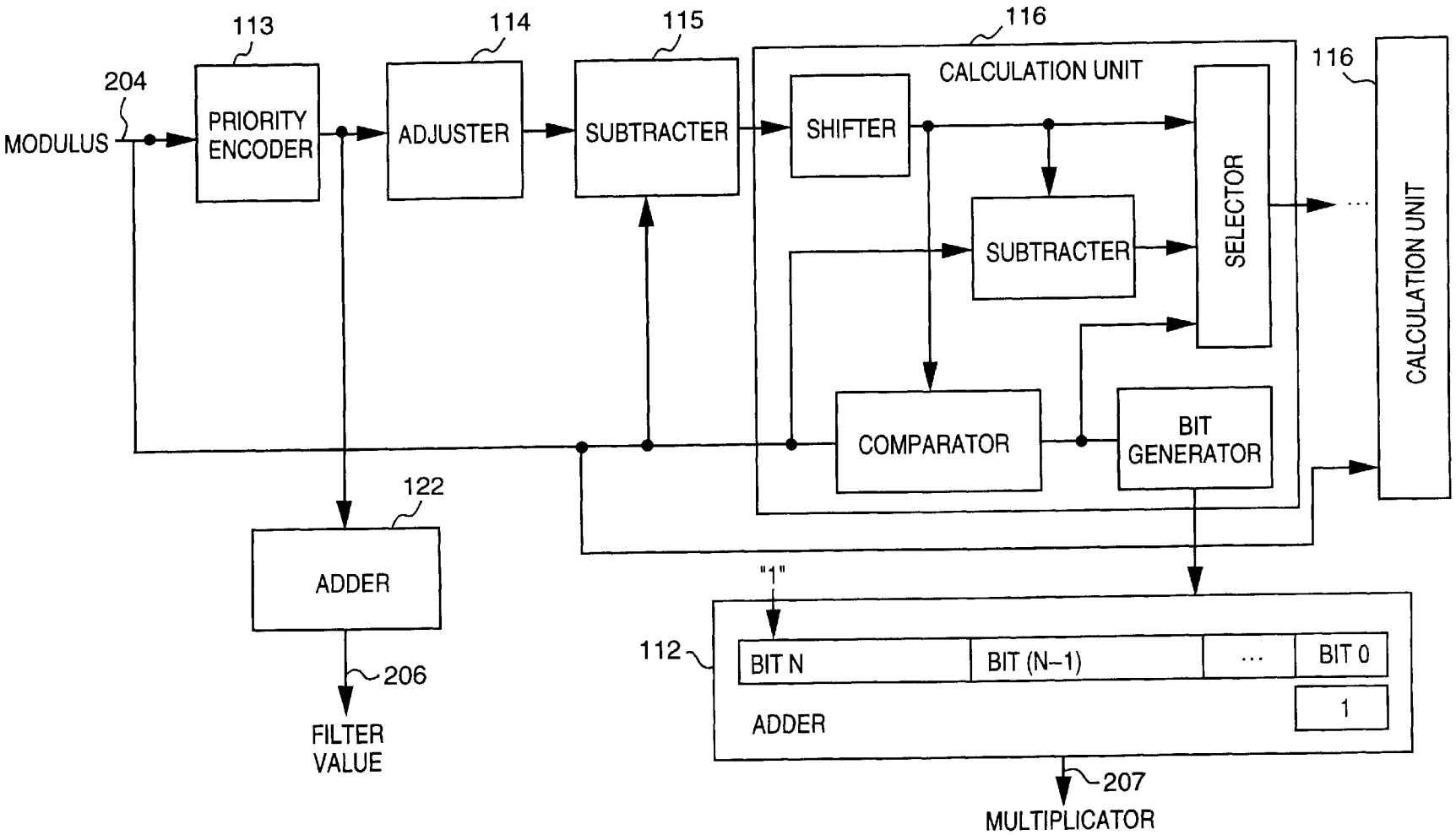
FIG. 18 is a block diagram showing the arrangement of a reciprocal number calculator.

FIG. 18 is a block diagram showing the arrangement of the reciprocal number calculator 103.

In the reciprocal number calculator 103, the modulus 204 (0000000000011001) input from the prime calculator 102 is input to a priority encoder 113, and a value "0100" is obtained as the processing result of the encoder 113. An adder 122 adds "10000" to the value "0100" and outputs the sum "10100" as a filter value 206. Also, an adjuster 114 outputs a value "0000000000100000" as hexadecimal expression of a value "100000" obtained by adding five "0"s to "1" on the basis of the output "0100" of the priority encoder 113.

A subtracter 115 subtracts the modulus 204 (0000000000011001) from the prime calculator 102 from the output "0000000000100000" from the adjuster 114, and sends the subtraction result "0000000000000111" to a calculation unit 116. The calculation unit 116 obtains a 16-digit value "1010001111010111". A value "1010001111011000" obtained by adding "1" to the value output from the unit 116 by an adder 112 is output, as a multiplicator 207, to the multiplier 104.

Figure 19:
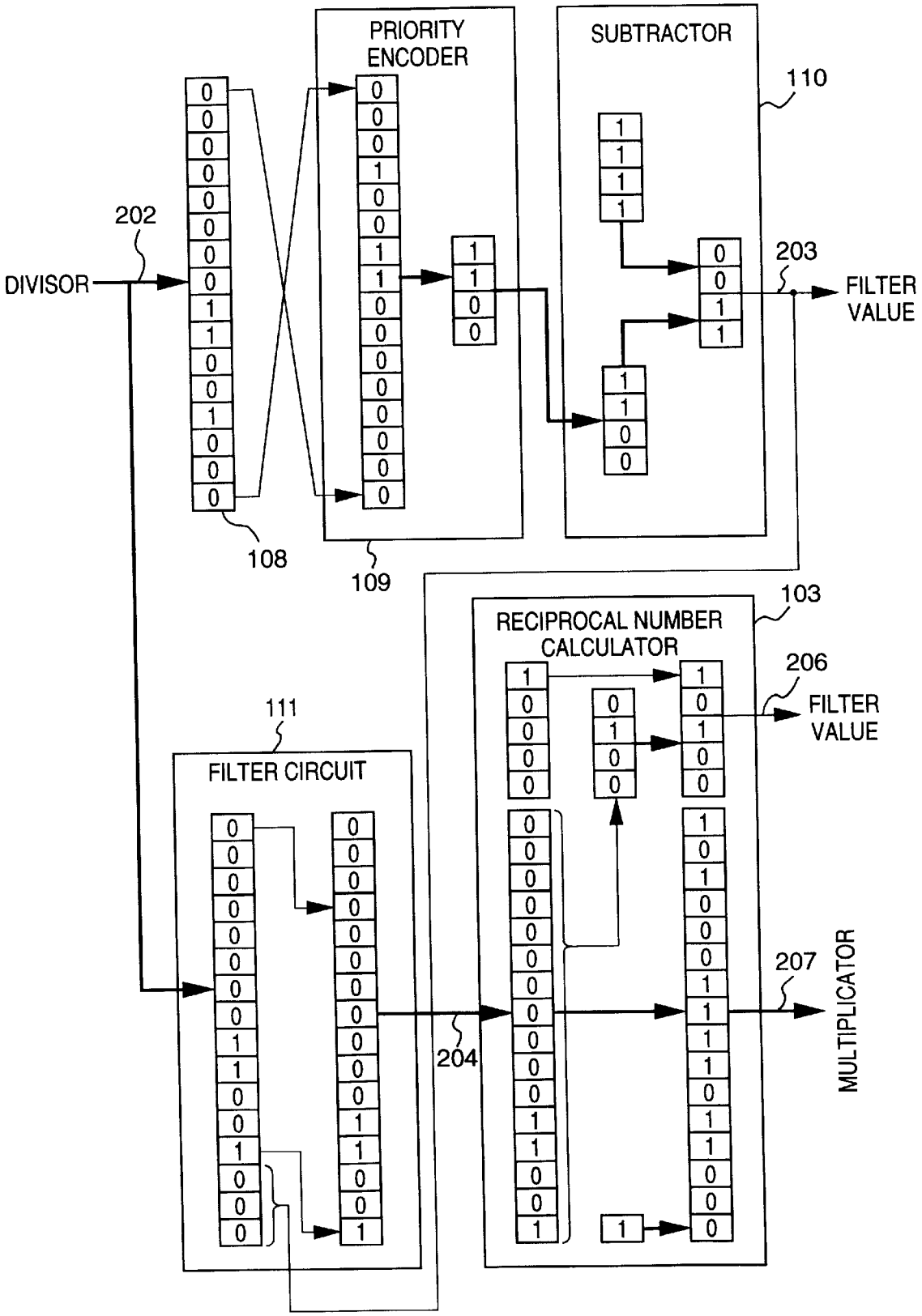
FIG. 19 is a diagram showing an example of the division processing in a divider of the embodiment shown in FIG. 1.
Figure 20:
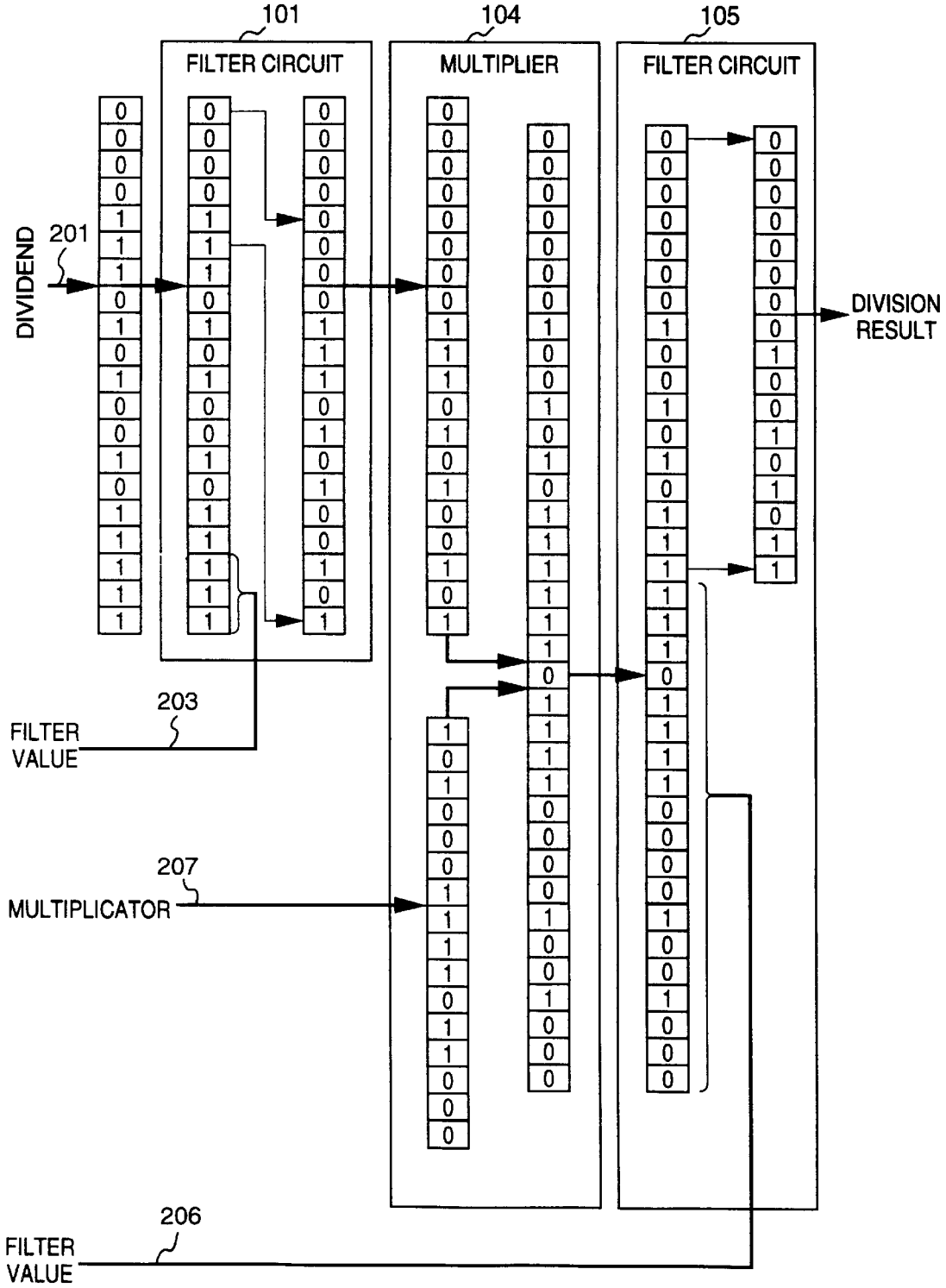
FIG. 20 is a diagram showing an example of the division processing in the divider of the embodiment shown in FIG. 1.
Figure 21:
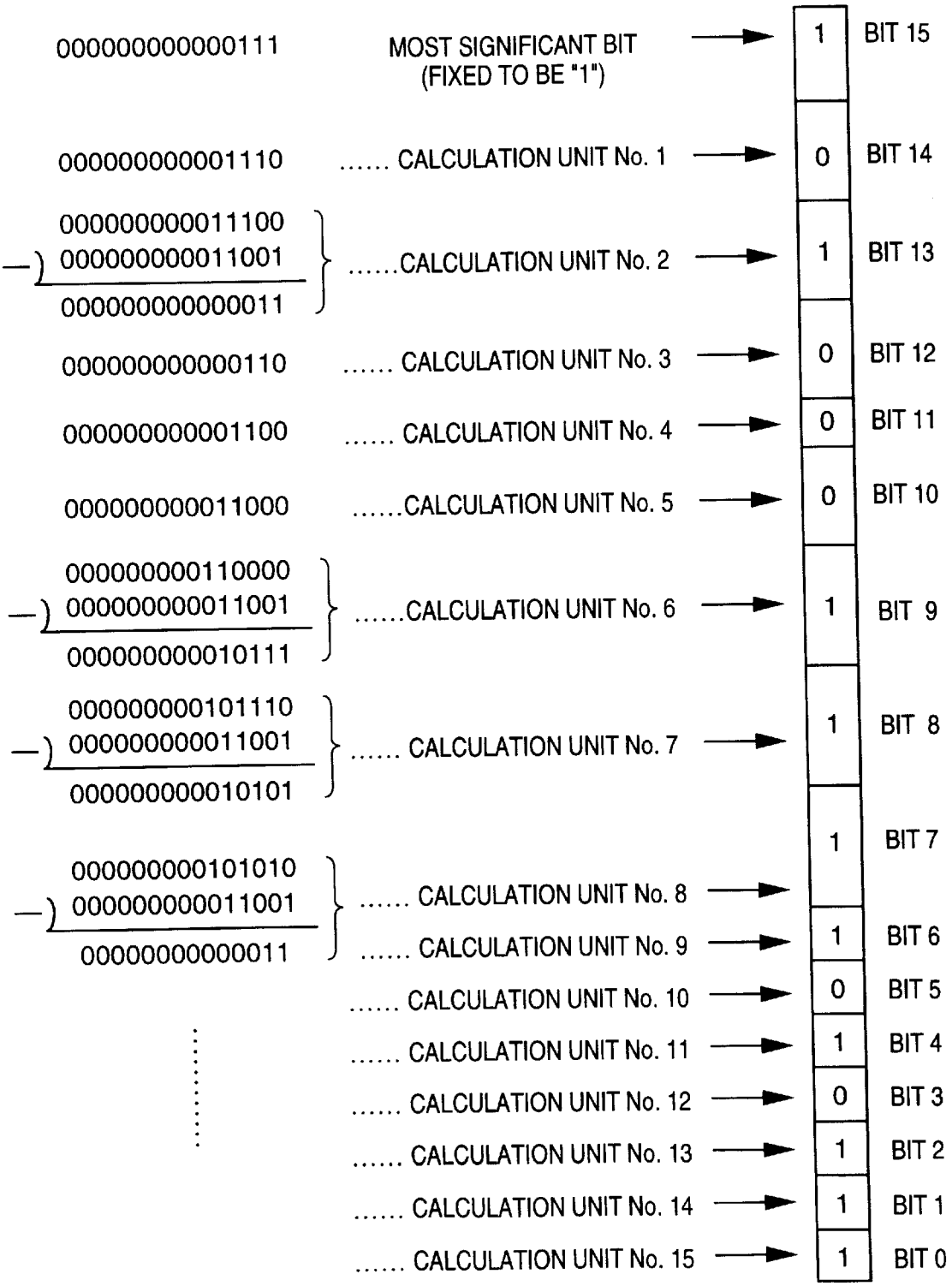
FIG. 21 is a diagram showing an example of the division processing in the divider of the embodiment shown in FIG. 1.

FIGS. 19 to 21 show the above-mentioned operations.

The operation of the divider 2909 based on the above-mentioned arrangement will be described below using an example of data.

Assume that the SVGA 21 rewrites data at the 300th line. Since the addresses of the 300th line are "E998" to "EA5F" as hexadecimal notation (HEX), the signals CAS1* and WE<7:4>* are asserted by RAS address "01D (HEX)" and CAS address "097 (HEX)" to make an access. The address latch circuit 2907 generates 20-bit address data "00001110101001011111" having the data format shown in FIG. 12B. The filter circuit 101 of the divider 2909 deletes lower 3 bits of this 20-bit address data on the basis of the filter value 203 (0011) generated by the prime calculator 102, and outputs the processing result value "0001110101001011" to the multiplier 104 as a multiplicand. The multiplier 104 multiplies the multiplicator 207 (101000111101000) from the reciprocal number calculator 103 with the multiplicand "0001110101001011" from the filter circuit 101. The lower 20 bits of the multiplication result "10010101111110111100001001000" are deleted by the filter circuit 105 on the basis of the filter value "10100" from the reciprocal number calculator 103. In this manner, the division result "0000000100101011" (=299) is output from the divider 2909.

The number of VRAM addresses corresponding to the horizontal resolution is set in the horizontal line number register 2912 by the CPU 23 on the basis of the total number (TPXEL) of pixels set in the SVGA 21 by the host CPU 1. In this case, the values to be set in the horizontal line number register 2912 at respective resolutions are as follows:

800×600×16 colors . . . 100
800×600×256 colors . . . 200
800×600×32K colors . . . 400
1,024×768×16 colors . . . 128
1,024×768×256 colors . . . 256
1,024×768×32K colors . . . 512
1,280×1,024×16 colors . . . 160
1,280×1,024×256 colors . . . 320
1,280×1,024×32K colors . . . 640

In this manner, the decoder 2910 can obtain the rewritten line number (in this case, "300"=299+1) by decoding the value "000000100101011" (=299) obtained by the divider 2909. With the above-mentioned processing, flag information obtained in units of rewrite operations of the VRAM 22 is stored in the flag register 2913. When the contents of the flag register 2913 are read out by the CPU 23 via the signal line 31, the flag register 2913 is cleared after the completion of the reading operation. When a power switch of the information processing system is turned on, the flag contents can be initialized by a flag initialization command (INFLG) from the CPU 23.

Upon reception of the total number (TLINE) of display lines per screen, the number (TPXEL) of pixels per line, and the like input from the host CPU 1, the CPU 23 sets the bandwidth (BAND) and the total number (TPXEL) of pixels to be subjected to image processing, and a halftone processing mode (e.g., a processing mode such as the error diffusion method, dither method, or the like) in the binary halftone processing circuit 26, and also outputs data indicating the total number (TLINE) of lines, the total number (TPXEL) of pixels, and the border area (BAREA) to the line address generation circuit 24.

Figure 22:
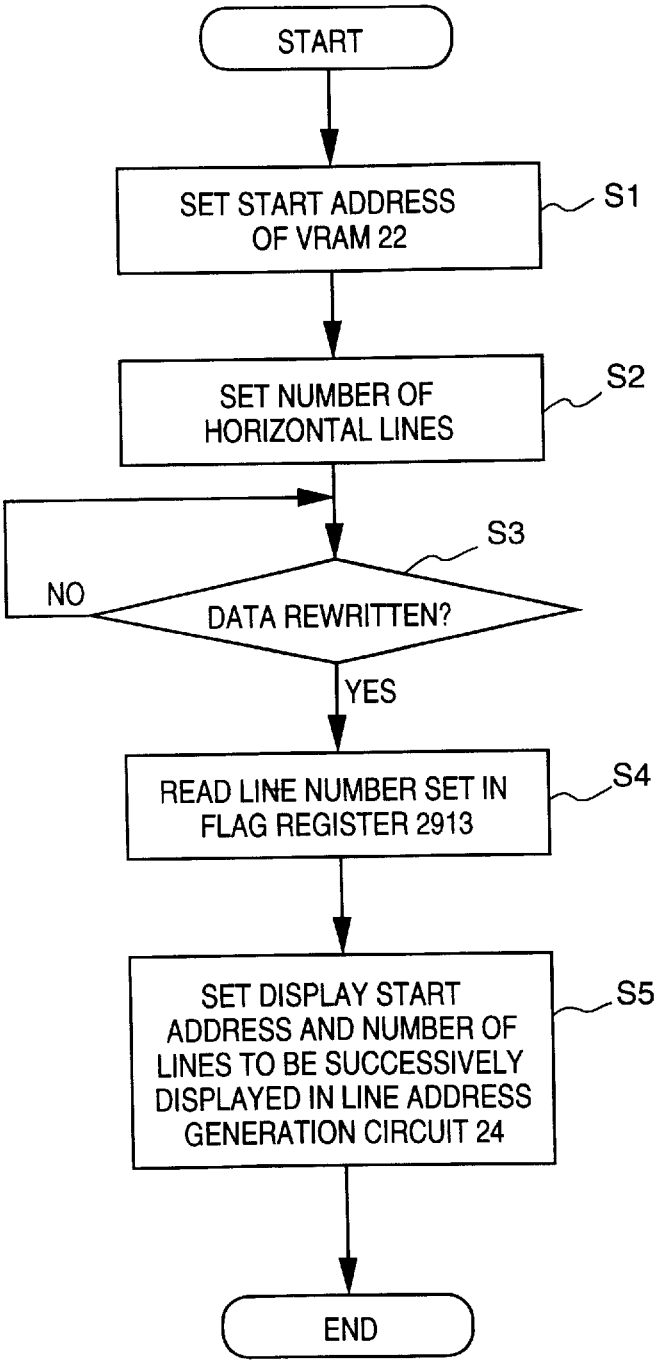
FIG. 22 is a flow chart showing the operation of a CPU in the FLCD interface unit.

The processing shown in the flow chart in FIG. 22 is other than the above-mentioned setting processing. That is, FIG. 22 is a flow chart showing the processing for, when data on the VRAM 22 is rewritten, obtaining the line number corresponding to the rewritten address.

In step S1, the display start address is set in the SSA register 2911 of the line flag generation circuit 29, and the number of pixels for one line is set in the horizontal line number register 2912. The flow then advances to step S3, and the control waits for a signal input from the line flag generation circuit 29 and indicating that data on the VRAM 22 has been rewritten. Upon reception of this signal via the signal line 31, the flow advances to step S4, and the contents of the flag register 2913 of the line flag generation circuit 29 are read to obtain the rewritten line number. After the rewritten line number is obtained, the flow advances to step 5, and the display start line address (DSLADR) and the number (SDLINE) of lines to be successively displayed are output to the line address generation circuit 24. In accordance with the display start line address and the number of lines to be successively displayed which are set as described above, the line address generation circuit 24 outputs the line address and display data in synchronism with the signal HSYNC output from the FLCD 20 at the next timing.

<Second Embodiment>

The arrangement of the address latch circuit 2907 according to the second embodiment of the present invention will be described below with reference to FIGS. 23 to 25B.

Figure 23:
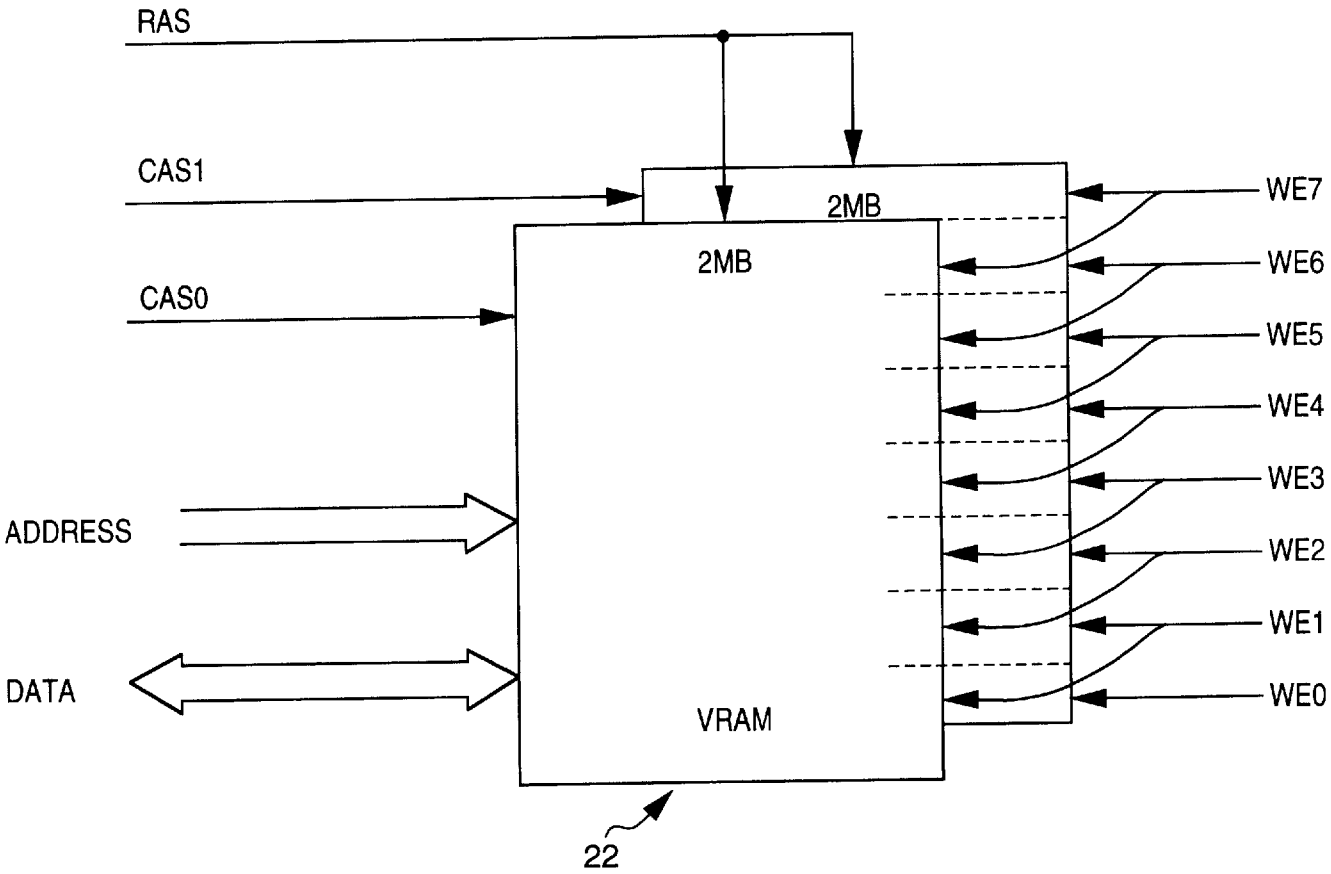
FIG. 23 is a diagram for explaining the arrangement of the VRAM of the embodiment shown in FIG. 1.

FIG. 23 is a diagram showing the arrangement of the VRAM 22 according to the second embodiment of the present invention. In this embodiment, the VRAM 22 has two frame memories each having a 2-Mbyte memory space. With this arrangement, the VRAM 22 can be used as a memory having a 4-, 2-, or 1-Mbyte memory space.

Figure 24:
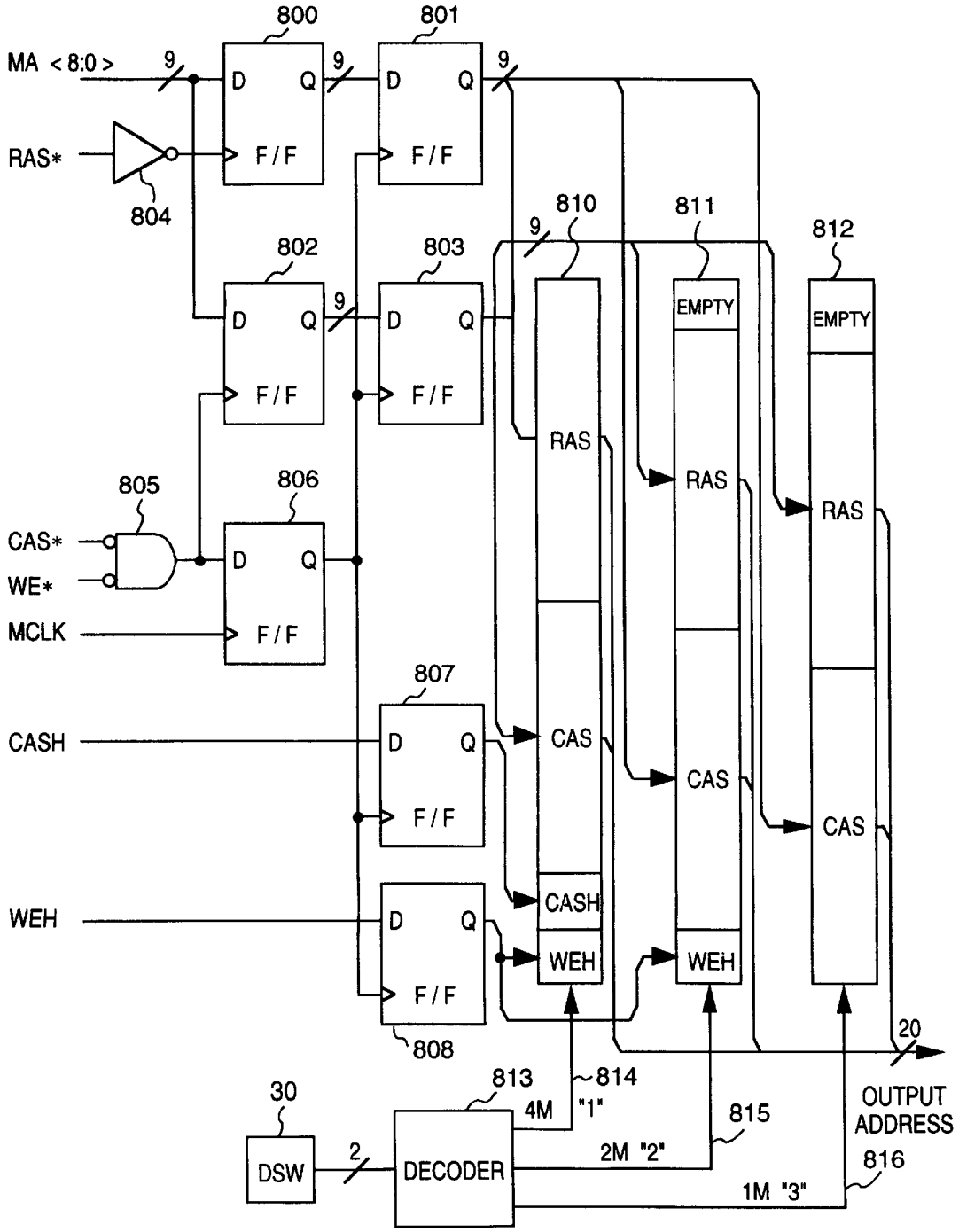
FIG. 24 is a circuit diagram showing the arrangement of an address latch circuit according to the second embodiment of the present invention.

FIG. 24 is a block diagram showing the arrangement of the address latch circuit 2907 of the second embodiment. The same reference numerals in FIG. 24 denote the same parts as in the arrangement of the first embodiment described above, and a detailed description thereof will be omitted. In FIG. 24, the DIP switch 30 for defining the memory space of the VRAM 22 is connected not to the CPU 23 but to the line flag generation circuit 29. The setting value of the switch 30 is decoded by a decoder 813, and one of latch circuits 810 to 812 is selected based on the decoded value.

Figure 25A:
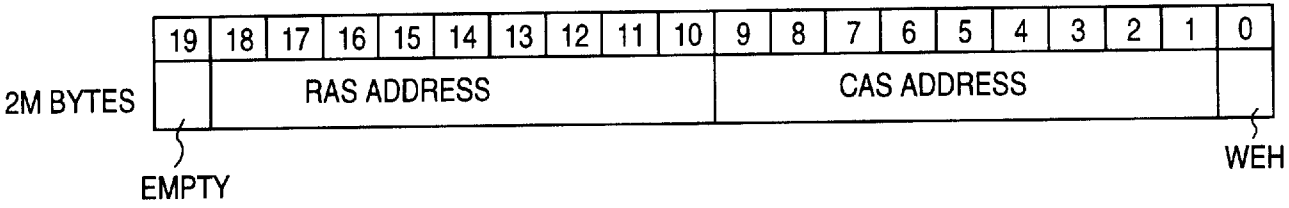
FIGS. 25A and 25B are views for explaining the addresses generated by the address latch circuit in correspondence with the memory space of the VRAM.
Figure 25B:
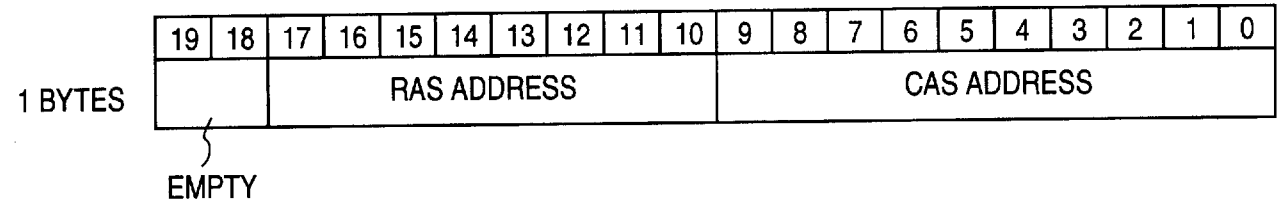

The latch circuit 810 is one for latching the address when the VRAM 22 is used as the 4-Mbyte memory space, the latch circuit 811 is one for latching the address when the VRAM 22 is used as the 2-Mbyte memory space, and the latch circuit 812 is one for latching the address when the VRAM 22 is used as the 1-Mbyte memory space. For example, when the DIP switch 30 is set to be "1", the VRAM 22 is used as the 4-Mbyte memory space, and the latch circuit 810 latches address data shown in FIG. 12B above and outputs 20-bit address data to the subsequent subtracter 2908. On the other hand, when the VRAM 22 is used as the 2-Mbyte memory space, the dip switch 30 is set to be "2". In this case, the latch circuit 811 latches 19-bit address data shown in FIG. 25A, and outputs it to the subtracter 2908. Similarly, when the VRAM 22 is used as the 1-Mbyte memory space, the dip switch 30 is set to be "31", and 18-bit address data shown in FIG. 25B is set in the latch circuit 812 and is output to the subtracter 2908.

As described above, according to the second embodiment, even when the memory space of the VRAM 22 is changed, an accurate address on the VRAM 22 subjected to the rewrite operation is stored in the address latch circuit 2907. For this reason, the subtracter 2908, the divider 2909, and the decoder 2910 can obtain the rewritten line number, and the contents of the flag register 2913 can be updated based on the obtained line number. According to the circuit of the second embodiment, even when the use mode (memory space) of the VRAM 22 is changed, the line number subjected to the partial rewriting operation can be obtained.

Note that the present invention may be applied to either a system constituted by a plurality of devices (e.g., a host computer, an interface device, a reader, a printer, and the like), or an apparatus comprising a single equipment (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU, MPU, or the like) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiment may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function expansion board or a function expansion unit, which is inserted in or connected to the computer and receives the program code read out from the storage medium.

As described above, according to the above-mentioned embodiments, the display line number on the corresponding display can be obtained at high speed on the basis of the rewritten address on the display memory.

According to the above-mentioned embodiments, since a high-speed divider using a multiplier is used, the corresponding display line number can be obtained at high speed.

According to the above-mentioned embodiments, even when the contents of the display memory are partially displayed, the display line number corresponding to the rewritten address on the display memory can be quickly and accurately obtained, and the display contents can be partially rewritten.

The present invention is not limited to the above embodiments and various changes and modifications can be made within the spirit and scope of the present invention. Therefore, to apprise the public of the scope of the present invention, the following claims are made.

What is claimed is:

1. A display controller for outputting display data stored in a display memory to a display so as to display the display data on a screen of the display, comprising:

an address memory for storing a binary address, subjected to a write access, of the display memory;

a reciprocal calculator for obtaining prime numbers of the number of display pixels of one horizontal line on the screen and for calculating a reciprocal number of the prime numbers, excluding two as a prime number;

a multiplier for multiplying a binary address shifted in accordance with the power of two in the prime numbers with the reciprocal number calculated by said reciprocal calculator; and horizontal line number determination means for obtaining a display line number of the screen on the basis of a multiplication result by said multiplier.

2. The controller according to claim 1, further comprising instruction means for assigning a memory space of the display memory, and wherein the address stored in said address memory is changed in accordance with an instruction from said instruction means.

3. The controller according to claim 1, wherein said horizontal line number determination means comprises decode means for decoding the multiplication result obtained by said multiplier, and obtains the line number on the basis of a decoded result of said decode means.

4. The controller according to claim 3, further comprising storage means for storing the display line number of the screen in accordance with the decoded result of said decode means.

5. The controller according to claim 1, further comprising display start address storage means for storing a display start position on the display in correspondence with an address of the display memory, and substraction means for subtracting a display start address stored in said display start address storage means from the address stored in said address memory, and wherein said multiplier multiplies the address as a result of said subtraction means by the number of display pixels, in the horizontal direction, of the screen of the display.

6. The controller according to claim 1, further comprising control means for reading out the line number determined by said horizontal line number determination means and displaying data corresponding to the line number from the display memory and outputting the display data to the display upon reception of a data transfer request signal from the display.

7. The controller according to claim 6, further comprising processing means for performing image processing of the display data read out from the display memory.

8. The controller according to claim 6, wherein the display data output to the display includes data indicating a display area and a non-display area.

9. The controller according to claim 1, wherein the display comprises a ferroelectric liquid crystal display.

10. A display apparatus for displaying an image, comprising:

a display memory storing display data;

a display unit having a screen for displaying an image based on the display data;

write means for writing display data by accessing said display memory;

an address memory for storing a binary address, accessed by said write means, of said display memory;

a reciprocal calculator for obtaining prime numbers of the number of display pixels of one horizontal line on the screen and for calculating a reciprocal number of the prime numbers, excluding two as a prime number;

a multiplier for multiplying a binary address shifted in accordance with the power of two in the prime numbers with the reciprocal number;

line number determination means for obtaining a display line number of the screen corresponding to the address accessed by said write means on the basis of the multiplication result of said multiplier; and control means for outputting the line number determined by said line number determination means and the display data corresponding to the display line number, which is stored in said display memory on said screen, upon reception of a display request from said display unit.

11. The apparatus according to claim 10, wherein said control means comprises processing means for performing image processing of the display data corresponding to the display line number determined by said line number determination means and stored in said display memory, and addition means for adding data indicating a non-display area to the display data processed by said processing means.

12. The apparatus according to claim 10, wherein said multiplier comprises a subtracter for subtracting an offset address of said display memory from the address stored in said address memory.

13. The apparatus according to claim 10, further comprising instruction means for assigning a memory space of said display memory, and wherein said address memory changes a holding state of the address in accordance with an instruction from said instruction means.

14. The apparatus according to claim 10, wherein said line number determination means comprises decode means for decoding the multiplication result obtained by said multiplier, and obtains the line number on the basis of the decoded result of said decode means.

15. The apparatus according to claim 14, further comprising storage means for storing the display line number of the display screen in accordance with the decoded result of said decode means.

16. The apparatus according to claim 10, further comprising display start address storage means for storing a display start position on said display unit in correspondence with an address of said display memory, and substraction means for subtracting a display start address stored in said display start address storage means from the address stored in said address memory, and wherein said multiplier multiplies the address as a result of said substraction means with the reciprocal number.

17. The apparatus according to claim 10, wherein said display comprises a ferroelectric liquid crystal display.

18. A display control method for outputting display data stored in a display memory to a display unit and displaying the display data on a screen of said display unit, comprising the steps of:

storing a binary address, subjected to a write access, of the display memory;

obtaining prime numbers of the number of display pixels of one horizontal line on the screen and calculating a reciprocal number line of a prime number, excluding two as the prime number;

multiplying a binary address shifted in accordance with the power of two in the prime numbers with the reciprocal number; and obtaining a display line number of the display screen corresponding to the address, subjected to the write access, of the display memory on the basis of the multiplication result.

19. The method according to claim 18, further comprising the step of:

assigning a memory space of the display memory, and wherein in the storing step, the address is changed in accordance with an instruction instructed in said instruction step.

20. The method according to claim 18, wherein in the obtaining step, decoding the multiplication result obtained by said multiplying step, and obtaining the line number on the basis of the decoded result of said decoding step.

21. The method according to claim 20, further comprising the step of:

storing the display line number of the display screen in accordance with the decoded result of said decoding step.

22. The method according to claim 18, further comprising the step of:

storing a display start address on the display in correspondence with an address of the display memory, and subtracting the display start address from the address stored in said storing step, and wherein in the multiplying step, the address as a subtraction result from said subtraction step is multiplied with the reciprocal number.

23. The method according to claim 18, further comprising the step of:

reading out the display line number, displaying data corresponding to the line number from the display memory, and outputting displaying data to the display unit upon reception of a data transfer request signal from the display unit.

24. The method according to claim 23, further comprising the step of:

performing image processing of the display data read out from the display memory.

25. The method according to claim 23, wherein the display data output to the display includes data indicating a display area and a non-display area.

26. The method according to claim 18, wherein the display comprises a ferroelectric liquid crystal display.

27. A display apparatus, comprising:

a display memory for storing display data;

a display screen for displaying an image based on the display data;

an address memory for storing a binary address, subjected to a write access, of said display memory;

a reciprocal calculator for obtaining prime numbers of the number of display pixels of one horizontal line on the display screen and for calculating a reciprocal number of the prime numbers, excluding two as a prime number;

a multiplier for multiplying a binary address shifted in accordance with the power of two in the prime numbers with the reciprocal number;

line number determination means for obtaining a display line number of the display screen corresponding to the address, subjected to the write access, of the display memory on the basis of a multiplication result from said multiplier, and display means for displaying an image on the display screen based on the display line number and display data.

28. An information processing apparatus for outputting display data stored in a display memory to a display unit and displaying the display data on the display screen of the display unit, comprising:

control means for generating display data and storing the display data into the display memory;

an address memory for storing a binary address, subjected to a write access by said control means, of the display memory;

a reciprocal calculator for obtaining prime numbers of the number of display pixels of one horizontal line on the display screen and for calculating a reciprocal number of the prime numbers, excluding two as a crime number;

a multiplier for multiplying a binary address shifted in accordance with the power of two in the prime numbers with the reciprocal number;

line number determination means for obtaining a display line number of the display screen corresponding to the address, subjected to the write access, of the display memory on the basis of a multiplication result from said multiplier; and display means for displaying an image on the display screen of the display unit based on the display line number and display data.

* * * * *

UNITED STATES PATENT AND TRADEMARK OFFICE

CERTIFICATE OF CORRECTION

PATENT NO. : 5,856,817

DATED : January 5, 1999

INVENTOR(S) : Matsuzaki

It is certified that error appears in the above-identified patent and that said Letters Patent is hereby corrected as shown below:

COLUMN 16:

Line 12, "crime" should read --prime--.

Signed and Sealed this

Thirty-first Day of August, 1999

*Attest:*

Q. TODD DICKINSON

*Attesting Officer*

*Acting Commissioner of Patents and Trademarks*